US006580884B2

(12) United States Patent
Kuwabara

(10) Patent No.: US 6,580,884 B2
(45) Date of Patent: Jun. 17, 2003

(54) IMAGE-FORMING DEVICE CONTROLLING A COOLING FAN ACCORDING TO A POSITION OF A TRANSFER SHEET BEING CONVEYED

(75) Inventor: Yoshihiro Kuwabara, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/026,684

(22) Filed: Dec. 27, 2001

(65) Prior Publication Data

US 2002/0085856 A1 Jul. 4, 2002

(30) Foreign Application Priority Data

Dec. 28, 2000 (JP) ..... 2000-399947
Feb. 28, 2001 (JP) ..... 2001-054726

(51) Int. Cl.[7] ..... G03G 21/00; G03G 15/00

(52) U.S. Cl. ..... 399/92; 399/45; 399/68; 399/82

(58) Field of Search ..... 399/92, 94, 43, 399/45, 67, 68, 82, 38, 44, 16; 219/216; 430/124

(56) References Cited

U.S. PATENT DOCUMENTS 6,253,042 B1 * 6/2001 Yang ..... 399/92
2002/0012543 A1 * 1/2002 Nakamura et al. ..... 399/92 X

FOREIGN PATENT DOCUMENTS

| | | | |
|---|---|---|---|
| JP | 60-122657 | * | 7/1985 |
| JP | 1-316757 | | 12/1989 |
| JP | 4-134459 | | 5/1992 |
| JP | 05-216320 | * | 8/1993 |
| JP | 7-319370 | | 12/1995 |
| JP | 8-30183 | | 2/1996 |
| JP | 09-062139 | * | 3/1997 |
| JP | 10-207326 | * | 8/1998 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

The image-forming device includes a fixing device for fixing a toner visible image transferred to a transfer sheet, a feeding device for feeding and conveying the transfer sheet to the fixing device, a cooling fan discharging a heat generated in the fixing device, a conveyance position detecting device for detecting a conveyance position of the transfer sheet being conveyed, and a controlling device for controlling the cooling fan to start and stop revolving according to the conveyance position.

44 Claims, 14 Drawing Sheets

IMAGE-FORMING DEVICE CONTROLLING A COOLING FAN ACCORDING TO A POSITION OF A TRANSFER SHEET BEING CONVEYED

BACKGROUND OF THE INVENTION

1. Field of the Invention

The present invention generally relates to an image-forming device, a recording medium, and an image-forming device controlling method, and more particularly, to an image-forming device, such as a printer incorporating a heat-fixing device, and a multifunctional copying machine, to a recording medium, and to an image-forming device controlling method.

2. Description of the Related Art

Conventionally, in a well-known electrophotographic recording device (an image-forming device), such as a printer or a copying machine, which performs a printing by a heat-fixing method, a toner image formed on a photosensitive member is transferred to a recording paper by using an electrostatic power, and thereafter the recording paper bearing the toner image is conveyed to a heat-fixing device. In this heat-fixing device, while the recording paper is supported and conveyed by a fixing roller and a pressuring roller, a predetermined fixing heat is applied to the toner image on the recording paper under pressure imposed by nip portions of the fixing roller and the pressuring roller so as to fix the toner image on the recording paper. Such a heat-fixing device generally incorporates a heater generating a Joule heat in the fixing roller.

Since the temperature in the device may be excessively elevated due to the heat generated from the heater, the electrophotographic recording device further comprises a cooling fan revolving so as to prevent the temperature rise in the device.

However, the cooling fan is often laid out in the vicinity of the heat-fixing device; therefore, when the recording paper (especially the leading end thereof) enters the heat-fixing device, toner particles transferred to the recording paper flow around due to an air current generated by the cooling fan such that blurred images are likely and creases may be created in the recording paper. This effect is prominent especially when the recording paper is thinner than a predetermined thickness.

Thereupon, there has been proposed an image-forming device that reduces a revolving velocity (revolutions per unit time) of the cooling fan lower than normal throughout a conveyance path, and mechanically adjusts an amount of airflow, according to a type of a recording paper (Japanese Laid-Open Patent Application No. 07-319370).

Besides, FIG. 1 shows a relation between a surface temperature of a fixing roller and an elapse time from the start of the fixing roller being revolved in a conventional heat-fixing device (a fixing unit). In FIG. 1, the axis of ordinates indicates the surface temperature of the fixing roller. $T_{FL}$ plotted on this ordinate axis indicates the lower limit of the fixing temperature. $T_{FH}$ indicates the upper limit of the fixing temperature. $T_W$ indicates a target value of the standby temperature. In FIG. 1, the surface temperature increases from the standby temperature $T_W$ to the upper limit $T_{FH}$, and then decreases due to an effect of the cooling fan. Thereafter, the surface temperature is maintained at a temperature $T_{FO}$ above the lower limit $T_{FL}$, while also being prevented from increasing excessively.

The technology disclosed in Japanese Laid-Open Patent Application No. 07-319370 can prevent the occurrence of the above-mentioned blurred images or creases by reducing the revolving velocity of the cooling fan lower than normal, especially when printing on a thin recording paper. However, an image-forming device is required not only to prevent ill influences due to an air current generated by revolutions of the cooling fan, but also to restrict a temperature increase in the device.

SUMMARY OF THE INVENTION

It is a general object of the present invention to provide an improved and useful image-forming device, a recording medium, and an image-forming device controlling method in which the above-mentioned problems are eliminated.

A more specific object of the present invention is to provide an image-forming device, a recording medium, and an image-forming device controlling method which can not only prevent a transfer paper from being influenced by an air current generated by revolutions of a cooling fan, but also can sufficiently restrict a temperature increase in the image-forming device by revolving the cooling fan.

In order to achieve the above-mentioned objects, there is provided according to one aspect of the present invention an image-forming device comprising:

fixing means for fixing a toner visible image transferred to a transfer sheet;

feeding means for feeding and conveying the transfer sheet to the fixing means;

a cooling fan discharging a heat generated in the fixing means;

conveyance-position detecting means for detecting a conveyance position of the transfer sheet being conveyed; and controlling means for controlling the cooling fan to start and stop revolving according to the conveyance position.

Normally, a cooling fan is used to prevent the temperature rise in an image-forming device. However, when a transfer sheet (especially the leading end thereof) enters a fixing device, toner particles transferred to the transfer sheet flow around due to an air current generated by the cooling fan such that blurred images are likely to be produced and creases may be created in the transfer sheet. Thereupon, by controlling the start/stop of the cooling fan according to the above-mentioned conveyance position, the air current generated by the cooling fan is prevented from affecting the transfer sheet after a transferring process until the completion of a fixing process. This makes it possible to eliminate the above-mentioned inconveniences of blurred images or creases in the transfer sheet, while keeping the reduction of cooling effects as little as possible.

In order to achieve the above-mentioned objects, there is also provided according to another aspect of the present invention an image-forming device comprising:

fixing means for fixing a toner visible image transferred to a transfer sheet;

feeding means for feeding and conveying the transfer sheet to the fixing means;

a cooling fan discharging a heat generated in the fixing means by revolving at a variable revolving velocity;

conveyance-position detecting means for detecting a conveyance position of the transfer sheet being conveyed; and controlling means for controlling the revolving velocity of the cooling fan according to the conveyance position.

When the revolving velocity (revolutions per unit time) of the cooling fan is variable, the revolving velocity of the cooling fan is controlled according to positions of the transfer sheet being conveyed. This makes it possible to prevent the reduction of cooling effects much further than when the start/stop of the cooling fan is controlled.

In order to achieve the above-mentioned objects, there is also provided according to another aspect of the present invention an image-forming device comprising:

fixing means for fixing a toner visible image transferred to a transfer sheet;

feeding means for feeding and conveying the transfer sheet to the fixing means;

a cooling fan discharging a heat generated in the fixing means;

timing means for measuring a conveying time of the transfer sheet being conveyed; and controlling means for calculating a conveyance position of the transfer sheet being conveyed, based on the conveying time and a predetermined conveying velocity, so as to control the cooling fan to start and stop revolving according to the conveyance position.

In cases where there are not provided conveyance sensors necessary for a cooling-fan control at sufficient positions on a conveyance path of the transfer sheet, a position of the transfer sheet being conveyed can be estimated by calculating a timing of the transfer sheet being conveyed, based on information detected by an existing conveyance sensor and a predetermined conveying velocity. Therefore, according to this estimation, the start/stop of the cooling fan can be controlled.

In order to achieve the above-mentioned objects, there is also provided according to another aspect of the present invention an image-forming device comprising:

fixing means for fixing a toner visible image transferred to a transfer sheet;

feeding means for feeding and conveying the transfer sheet to the fixing means;

a cooling fan discharging a heat generated in the fixing means by revolving at a variable revolving velocity;

timing means for measuring a conveying time of the transfer sheet being conveyed; and controlling means for calculating a conveyance position of the transfer sheet being conveyed, based on the conveying time and a predetermined conveying velocity, so as to control the revolving velocity of the cooling fan according to the conveyance position.

In cases where there are not provided conveyance sensors necessary for a cooling-fan control at sufficient positions on a conveyance path of the transfer sheet, the conveyance position of the transfer sheet can be estimated by calculating a timing of the transfer sheet being conveyed, based on information detected by an existing conveyance sensor and a predetermined conveying velocity. Therefore, according to this estimation, the revolving velocity of the cooling fan can be controlled.

Additionally, in the image-forming device according to the present invention, the feeding means may continuously feed and convey a plurality of transfer sheets to the fixing means, and the controlling means may control the cooling fan to stop revolving when a preceding transfer sheet exists in a predetermined conveying range.

When a plurality of transfer sheets are being conveyed through the image-forming device, the transfer sheets are at different conveyance positions. Therefore, simply starting and stopping the cooling fan according to a position of a transfer sheet causes a confliction of processes with other transfer sheets being conveyed. Thereupon, when even one transfer sheet is being conveyed between the transferring device and the entrance of the fixing device, the start/stop of the cooling fan is exclusively controlled with respect to the transfer sheet. This eliminates the above-mentioned inconveniences even upon a continuous printing.

Additionally, in the image-forming device according to the present invention, the feeding means may continuously feed and convey a plurality of transfer sheets to the fixing means, and when a preceding transfer sheet exists in a predetermined conveying range, the controlling means may control the cooling fan to revolve at a revolving velocity lower than an initial revolving velocity upon the start of feeding the transfer sheets.

When a plurality of transfer sheets are being conveyed through the image-forming device, the transfer sheets are at different conveyance positions. Therefore, simply starting and stopping the cooling fan according to a position of a transfer sheet causes a confliction of processes with other transfer sheets being conveyed. Thereupon, when even one transfer sheet is being conveyed between the transferring device and the entrance of the fixing device, the revolving velocity of the cooling fan is exclusively controlled with respect to the transfer sheet. This eliminates the above-mentioned inconveniences even upon a continuous printing.

Additionally, in the image-forming device according to the present invention, the controlling means may control the cooling fan to stop revolving or to revolve at a revolving velocity lower than the initial revolving velocity at least while the transfer sheet is conveyed from transferring means to the fixing means, the transferring means transferring the toner visible image to the transfer sheet.

While a transfer sheet is conveyed from a transferring device (a transfer roller, a photosensitive member, etc.) to a fixing device, an air current generated by the cooling fan may likely flow toner particles on the transfer sheet. Thereupon, controlling the cooling fan to stop revolving or to revolve at a revolving velocity lower than the initial revolving velocity can eliminate the above-mentioned inconveniences of blurred images or creases in the transfer sheet, while keeping the reduction of cooling effects as little as possible.

Additionally, the image-forming device according to the present invention may further comprise temperature-sensing means for sensing a temperature in the image-forming device, wherein the controlling means may control the cooling fan to start revolving or to revolve at the initial revolving velocity when the temperature-sensing means senses a temperature equal to or higher than a predetermined temperature.

In this image-forming device, starting the revolution of the cooling fan or revolving the cooling fan at the above-mentioned initial revolving velocity according to the temperature in the image-forming device can prevent an abnormal increase in temperature so as to restrict the reduction of cooling effects.

Additionally, in the image-forming device according to the present invention, the controlling means may control the cooling fan to start revolving or to revolve at the initial revolving velocity when a predetermined time elapses since the cooling fan has stopped revolving or has been revolving at the revolving velocity lower than the initial revolving velocity.

It is not preferable to keep stopping the cooling fan or to keep reducing the revolving velocity of the cooling fan, because this may impair the cooling effects. Thereupon, when a predetermined time has elapsed, starting the cooling fan automatically or returning the revolving velocity of the cooling fan to the above-mentioned initial revolving velocity can maintain the cooling effects.

Additionally, the image-forming device according to the present invention may further comprise mode-setting means for setting a thin-sheet mode indicating that the transfer sheet is thinner than a predetermined thickness, wherein the controlling means may control the cooling fan to start and stop revolving, or may control the revolving velocity of the cooling fan, according to the conveyance position, in the thin-sheet mode.

When a transfer sheet is thinner than a predetermined thickness, toner particles transferred to the transfer sheet are more likely to flow around due to an air current generated by the cooling fan, before the transfer sheet enters the fixing device. Thereupon, only in the thin-sheet mode, the start/stop of the cooling fan or the revolving velocity thereof can be controlled according to a position of the transfer sheet being conveyed so as to eliminate the above-mentioned inconveniences of blurred images or creases in the thinner transfer sheet, while maintaining cooling effects of an ordinary cooling-fan control with respect to a normal transfer sheet as thick as or thicker than the predetermined thickness.

In order to achieve the above-mentioned objects, there is also provided according to another aspect of the present invention a computer readable recording medium storing program code for causing an image-forming device to control fixing means for fixing a toner visible image transferred to a transfer sheet, feeding means for feeding and conveying the transfer sheet to the fixing means, a cooling fan discharging a heat generated in the fixing means, and conveyance-position detecting means for detecting a conveyance position of the transfer sheet being conveyed, the recording medium comprising:

conveyance-position detecting program code means for detecting the conveyance position of the transfer sheet being conveyed; and controlling program code means for controlling the cooling fan to start and stop revolving according to the conveyance position, or for controlling the revolving velocity of the cooling fan according to the conveyance position.

By providing the image-forming device with a recording medium storing programs for controlling the start/stop of the cooling fan, or for controlling the revolving velocity of the cooling fan, according to the above-mentioned conveyance position of a transfer sheet judged from information detected by a resist sensor, etc., a controller (or a CPU) of the image-forming device can easily obtain the above-mentioned programs. The controller executes the programs so as to eliminate the above-mentioned inconveniences of blurred images or creases in the transfer sheet while keeping the reduction of cooling effects as little as possible.

In order to achieve the above-mentioned objects, there is also provided according to another aspect of the present invention a computer readable recording medium storing program code for causing an image-forming device to control fixing means for fixing a toner visible image transferred to a transfer sheet, feeding means for feeding and conveying the transfer sheet to the fixing means, a cooling fan discharging a heat generated in the fixing means, and timing means for measuring a conveying time of the transfer sheet being conveyed, the recording medium comprising:

conveyance-position calculating program code means for calculating a conveyance position of the transfer sheet being conveyed, based on the conveying time and a predetermined conveying velocity; and controlling program code means for controlling the cooling fan to start and stop revolving according to the conveyance position, or for controlling the revolving velocity of the cooling fan according to the conveyance position.

By providing the image-forming device with a recording medium storing programs for controlling the start/stop of the cooling fan, or for controlling the revolving velocity of the cooling fan, according to the above-mentioned conveyance position of a transfer sheet calculated from information detected by a resist sensor, the conveying time of the transfer sheet measured by the timing means, the predetermined conveying velocity, etc., a controller of the image-forming device can easily obtain the above-mentioned programs. The controller executes the programs so as to eliminate the above-mentioned inconveniences of blurred images or creases in the transfer sheet while keeping the reduction of cooling effects as little as possible.

In order to achieve the above-mentioned objects, there is also provided according to another aspect of the present invention a computer readable recording medium storing program code for causing an image-forming device to control transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, and conveyance-position detecting means for detecting a conveyance position of the transfer sheet being conveyed, the recording medium comprising:

conveyance-position detecting program code means for detecting the conveyance position of the transfer sheet being conveyed; and controlling program code means for controlling the cooling fan to stop revolving, or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means.

The image-forming device can be provided with a recording medium storing programs for controlling the cooling fan to stop revolving, or to revolve at a revolving velocity lower than the above-mentioned initial revolving velocity, when a preceding transfer sheet exists between the transferring device and the fixing device, while controlling the start/stop of the cooling fan, or controlling the revolving velocity of the cooling fan, according to the above-mentioned conveyance position of a transfer sheet judged from information detected by a resist sensor, etc. In this arrangement, a controller of the image-forming device can easily obtain the above-mentioned programs. The controller executes the programs so as to eliminate the above-mentioned inconveniences of blurred images or creases in the transfer sheet while maintaining the cooling effects, even when continuously feeding and conveying a plurality of transfer sheets.

In order to achieve the above-mentioned objects, there is also provided according to another aspect of the present invention a computer readable recording medium storing program code for causing an image-forming device to control transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, and timing means for measuring a conveying time of the transfer sheet being conveyed, the recording medium comprising:

conveyance-position calculating program code means for calculating a conveyance position of the transfer sheet being conveyed, based on the conveying time and a predetermined conveying velocity; and controlling program code means for controlling the cooling fan to stop revolving, or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means.

The image-forming device can be provided with a recording medium storing programs for controlling the cooling fan to stop revolving, or to revolve at a revolving velocity lower than the above-mentioned initial revolving velocity, when a preceding transfer sheet exists between the transferring device and the fixing device, while controlling the start/stop or the revolving velocity of the cooling fan according to the above-mentioned conveyance position of a transfer sheet calculated from information detected by a resist sensor, the conveying time of the transfer sheet measured by the timing means, the predetermined conveying velocity, etc. In this arrangement, a controller of the image-forming device can easily obtain the above-mentioned programs. The controller executes the programs so as to eliminate the above-mentioned inconveniences of blurred images or creases in the transfer sheet while maintaining the cooling effects, even when continuously feeding and conveying a plurality of transfer sheets.

In order to achieve the above-mentioned objects, there is also provided according to another aspect of the present invention a computer readable recording medium storing program code for causing an image-forming device to control transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, conveyance-position detecting means for detecting a conveyance position of the transfer sheet being conveyed, and temperature-sensing means for sensing a temperature in the image-forming device, the recording medium comprising:

conveyance-position detecting program code means for detecting the conveyance position of the transfer sheet being conveyed;

first controlling program code means for controlling the cooling fan to stop revolving or to revolve at a revolving velocity lower than an initial revolving velocity upon the start of feeding transfer sheets when a transfer sheet preceding the present transfer sheet exists between the transferring means and the fixing means while continuously feeding and conveying a plurality of transfer sheets to the fixing means; and second controlling program code means for controlling the cooling fan to start revolving or to revolve at the initial revolving velocity when the temperature in the image-forming device becomes equal to or higher than a predetermined temperature since the cooling fan is stopped revolving or is revolved at the revolving velocity lower than the initial revolving velocity by the first controlling program code means.

The image-forming device can be provided with a recording medium storing programs for not only controlling the cooling fan to stop revolving, or to revolve at a revolving velocity lower than the above-mentioned initial revolving velocity, when a preceding transfer sheet exists between the transferring device and the fixing device, but also controlling the cooling fan to start revolving or to revolve at the initial revolving velocity when the temperature in the image-forming device becomes equal to or higher than a predetermined temperature, while controlling the start/stop or the revolving velocity of the cooling fan according to the above-mentioned conveyance position of a transfer sheet judged from information detected by a resist sensor, etc. In this arrangement, a controller of the image-forming device can easily obtain the above-mentioned programs. The controller executes the programs so as to eliminate the above-mentioned inconveniences of blurred images or creases in the transfer sheet while maintaining sufficient cooling effects, even when continuously feeding and conveying a plurality of transfer sheets.

In order to achieve the above-mentioned objects, there is also provided according to another aspect of the present invention a computer readable recording medium storing program code for causing an image-forming device to control transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, and timing means for measuring a conveying time of the transfer sheet being conveyed, the recording medium comprising:

conveyance-position calculating program code means for calculating a conveyance position of the transfer sheet being conveyed, based on the conveying time and a predetermined conveying velocity;

first controlling program code means for controlling the cooling fan to stop revolving or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means; and second controlling program code means for controlling the cooling fan to start revolving or to revolve at the initial revolving velocity when a predetermined time elapses since the cooling fan is stopped revolving or is revolved at the revolving velocity lower than the initial revolving velocity by the first controlling program code means.

The image-forming device can be provided with a recording medium storing programs for not only controlling the cooling fan to stop revolving, or to revolve at a revolving velocity lower than the above-mentioned initial revolving velocity, when a preceding transfer sheet exists between the transferring device and the fixing device, but also controlling the cooling fan to start revolving or to revolve at the initial revolving velocity when a predetermined time elapses since the cooling fan has been stopped revolving or revolved at the revolving velocity lower than the initial revolving velocity, while controlling the start/stop or the revolving velocity of the cooling fan according to the above-mentioned conveyance position of a transfer sheet calculated from information detected by a resist sensor, the conveying time of the transfer sheet measured by the timing means, the predetermined conveying velocity, etc. In this arrangement, a controller of the image-forming device can easily obtain the above-mentioned programs. The controller executes the programs so as to eliminate the above-mentioned inconveniences of blurred images or creases in the transfer sheet while maintaining the cooling effects, even when continuously feeding and conveying a plurality of transfer sheets.

Additionally, in the recording medium according to the present invention, the image-forming device may include mode-setting means for setting a thin-sheet mode indicating that the transfer sheet is thinner than a predetermined thickness, and the recording medium may further comprise:

mode confirming program code means for confirming whether or not the thin-sheet mode is set so that each of the above-mentioned program code means is performed only when the thin-sheet mode is set.

Especially when a transfer sheet is thinner than a predetermined thickness, toner particles transferred to the transfer sheet are more likely to flow around due to an air current generated by the cooling fan, before the transfer sheet enters the fixing device. Thereupon, the image-forming device can be provided with a recording medium storing programs for performing the above-mentioned thin-sheet mode. In this arrangement, a controller of the image-forming device can easily obtain the above-mentioned programs. The controller executes the programs so as to eliminate the above-mentioned inconveniences of blurred images or creases in the transfer sheet while maintaining sufficient cooling effects.

In order to achieve the above-mentioned objects, there is also provided according to another aspect of the present invention a method for controlling an image-forming device including fixing means for fixing a toner visible image transferred to a transfer sheet, feeding means for feeding and conveying the transfer sheet to the fixing means, a cooling fan discharging a heat generated in the fixing means, and conveyance-position detecting means for detecting a conveyance position of the transfer sheet being conveyed, the method comprising:

the conveyance-position detecting step of detecting the conveyance position of the transfer sheet being conveyed; and the controlling step of controlling the cooling fan to start and stop revolving according to the conveyance position, or controlling the revolving velocity of the cooling fan according to the conveyance position.

The image-forming device can read programs from a network in a file format or from a recording medium, the programs for performing the method of controlling the start/stop of the cooling fan, or of controlling the revolving velocity of the cooling fan, according to the above-mentioned conveyance position of a transfer sheet judged from information detected by a resist sensor, etc. A controller of the image-forming device executes the programs for performing the method so as to eliminate the above-mentioned inconveniences of blurred images or creases in the transfer sheet while maintaining sufficient cooling effects.

In order to achieve the above-mentioned objects, there is also provided according to another aspect of the present invention a method for controlling an image-forming device including fixing means for fixing a toner visible image transferred to a transfer sheet, feeding means for feeding and conveying the transfer sheet to the fixing means, a cooling fan discharging a heat generated in the fixing means, and timing means for measuring a conveying time of the transfer sheet being conveyed, the method comprising:

the conveyance-position calculating step of calculating a conveyance position of the transfer sheet being conveyed, based on the conveying time and a predetermined conveying velocity; and the controlling step of controlling the cooling fan to start and stop revolving according to the conveyance position, or controlling the revolving velocity of the cooling fan according to the conveyance position.

The image-forming device can read programs from a network in a file format or from a recording medium, the programs for performing the method of controlling the start/stop or the revolving velocity of the cooling fan according to the above-mentioned conveyance position of a transfer sheet calculated from information detected by a resist sensor, the conveying time of the transfer sheet measured by the timing means, the predetermined conveying velocity, etc. A controller of the image-forming device executes the programs for performing the method so as to eliminate the above-mentioned inconveniences of blurred images or creases in the transfer sheet while maintaining sufficient cooling effects.

In order to achieve the above-mentioned objects, there is also provided according to another aspect of the present invention a method for controlling an image-forming device including transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, and conveyance-position detecting means for detecting a conveyance position of the transfer sheet being conveyed, the method comprising:

the conveyance-position detecting step of detecting the conveyance position of the transfer sheet being conveyed; and the controlling step of controlling the cooling fan to stop revolving or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means.

The image-forming device can read programs from a network in a file format or from a recording medium, the programs for performing the method of controlling the cooling fan to stop revolving, or to revolve at a revolving velocity lower than the above-mentioned initial revolving velocity, when a preceding transfer sheet exists between the transferring device and the fixing device, while controlling the start/stop or the revolving velocity of the cooling fan according to the above-mentioned conveyance position of a transfer sheet judged from information detected by a resist sensor, etc. A controller of the image-forming device executes the programs for performing the method so as to eliminate the above-mentioned inconveniences of blurred images or creases in the transfer sheet while maintaining sufficient cooling effects, even when continuously feeding and conveying a plurality of transfer sheets.

In order to achieve the above-mentioned objects, there is also provided according to another aspect of the present invention a method for controlling an image-forming device including transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, and timing means for measuring a conveying time of the transfer sheet being conveyed, the method comprising:

the conveyance-position calculating step of calculating a conveyance position of the transfer sheet being conveyed, based on the conveying time and a predetermined conveying velocity; and the controlling step of controlling the cooling fan to stop revolving or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means.

The image-forming device can read programs from a network in a file format or from a recording medium, the programs for performing the method of controlling the cooling fan to stop revolving, or to revolve at a revolving velocity lower than the above-mentioned initial revolving velocity, when a preceding transfer sheet exists between the transferring device and the fixing device, while controlling the start/stop or the revolving velocity of the cooling fan according to the above-mentioned conveyance position of a transfer sheet calculated from information detected by a resist sensor, the conveying time of the transfer sheet measured by the timing means, the predetermined conveying velocity, etc. A controller of the image-forming device executes the programs for performing the method so as to eliminate the above-mentioned inconveniences of blurred images or creases in the transfer sheet while maintaining sufficient cooling effects, even when continuously feeding and conveying a plurality of transfer sheets.

In order to achieve the above-mentioned objects, there is also provided according to another aspect of the present invention a method for controlling an image-forming device including transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, conveyance-position detecting means for detecting a conveyance position of the transfer sheet being conveyed, and temperature-sensing means for sensing a temperature in the image-forming device, the method comprising:

the conveyance-position detecting step of detecting the conveyance position of the transfer sheet being conveyed;

the first controlling step of controlling the cooling fan to stop revolving or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means; and the second controlling step of controlling the cooling fan to start revolving or to revolve at the initial revolving velocity, when the temperature in the image-forming device becomes equal to or higher than a predetermined temperature since the cooling fan is stopped revolving or is revolved at the revolving velocity lower than the initial revolving velocity by the first controlling step.

The image-forming device can read programs from a network in a file format or from a recording medium, the programs for performing the method of not only controlling the cooling fan to stop revolving or to revolve at a revolving velocity lower than the above-mentioned initial revolving velocity, when a preceding transfer sheet exists between the transferring device and the fixing device, but also controlling the cooling fan to start revolving or to revolve at the initial revolving velocity when the temperature in the image-forming device becomes equal to or higher than a predetermined temperature, while controlling the start/stop or the revolving velocity of the cooling fan according to the above-mentioned conveyance position of a transfer sheet judged from information detected by a resist sensor, etc. A controller of the image-forming device executes the programs for performing the method so as to eliminate the above-mentioned inconveniences of blurred images or creases in the transfer sheet while maintaining sufficient cooling effects, even when continuously feeding and conveying a plurality of transfer sheets.

In order to achieve the above-mentioned objects, there is also provided according to another aspect of the present invention a method for controlling an image-forming device including transferring means for transferring a toner visible image to a transfer sheet, fixing means for fixing the toner visible image transferred to the transfer sheet, feeding means for feeding and conveying the transfer sheet to the fixing means, a cooling fan discharging a heat generated in the fixing means, and timing means for measuring a conveying time of the transfer sheet being conveyed, the method comprising:

the conveyance-position calculating step of calculating a conveyance position of the transfer sheet being conveyed, based on the conveying time and a predetermined conveying velocity;

the first controlling step of controlling the cooling fan to stop revolving or to revolve at a revolving velocity lower than an initial revolving velocity upon the start of feeding transfer sheets, when a transfer sheet preceding the present transfer sheet exists between the transferring means and the fixing means, while continuously feeding and conveying a plurality of transfer sheets to the fixing means; and the second controlling step of controlling the cooling fan to start revolving or to revolve at the initial revolving velocity, when a predetermined time elapses since the cooling fan is stopped revolving or is revolved at the revolving velocity lower than the initial revolving velocity by the first controlling step.

The image-forming device can read programs from a network in a file format or from a recording medium, the programs for performing the method of not only controlling the cooling fan to stop revolving or to revolve at a revolving velocity lower than the above-mentioned initial revolving velocity, when a preceding transfer sheet exists between the transferring device and the fixing device, but also controlling the cooling fan to start revolving or to revolve at the initial revolving velocity when a predetermined time elapses since the cooling fan has been stopped revolving or revolved at the revolving velocity lower than the initial revolving velocity, while controlling the start/stop or the revolving velocity of the cooling fan according to the above-mentioned conveyance position of a transfer sheet calculated from information detected by a resist sensor, the conveying time of the transfer sheet measured by the timing means, the predetermined conveying velocity, etc. A controller of the image-forming device executes the programs for performing the method so as to eliminate the above-mentioned inconveniences of blurred images or creases in the transfer sheet while maintaining sufficient cooling effects, even when continuously feeding and conveying a plurality of transfer sheets.

Additionally, in the image-forming device controlling method according to the present invention, the image-forming device may include mode-setting means for setting a thin-sheet mode indicating that the transfer sheet is thinner than a predetermined thickness, and the method may further comprise:

the mode confirming step of confirming whether or not the thin-sheet mode is set so that each of the above-mentioned steps is performed only when the thin-sheet mode is set.

Generally in an image-forming device, when a transfer sheet is thinner than a predetermined thickness, toner particles transferred to the transfer sheet are more likely to flow around due to an air current generated by the cooling fan, before the transfer sheet enters the fixing device. Thereupon, the image-forming device according to the present invention can read programs from a network in a file format or from a recording medium, the programs for performing the method of conducting the above-mentioned thin-sheet mode. A controller of the image-forming device executes the programs for performing the method so as to eliminate the above-mentioned inconveniences of blurred images or creases in the transfer sheet while maintaining sufficient cooling effects.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments according to the present invention.

Embodiment 1

Figure 1:
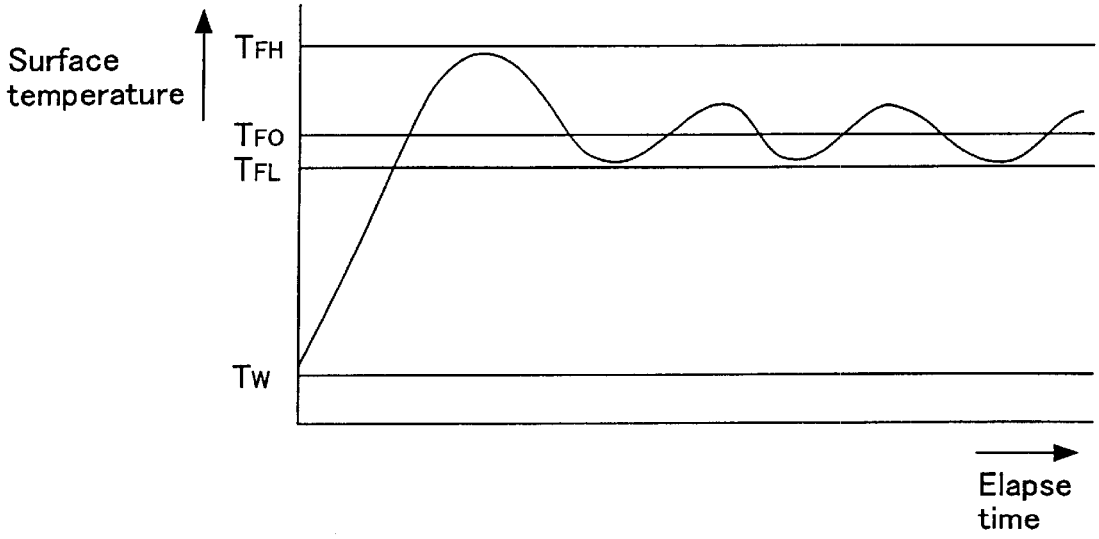
FIG.1 PRIOR ART
FIG. 1 is a graph showing a relation between a surface temperature of a fixing roller and an elapse time since the start of the fixing roller being revolved in a conventional heat-fixing device.
Figure 2:
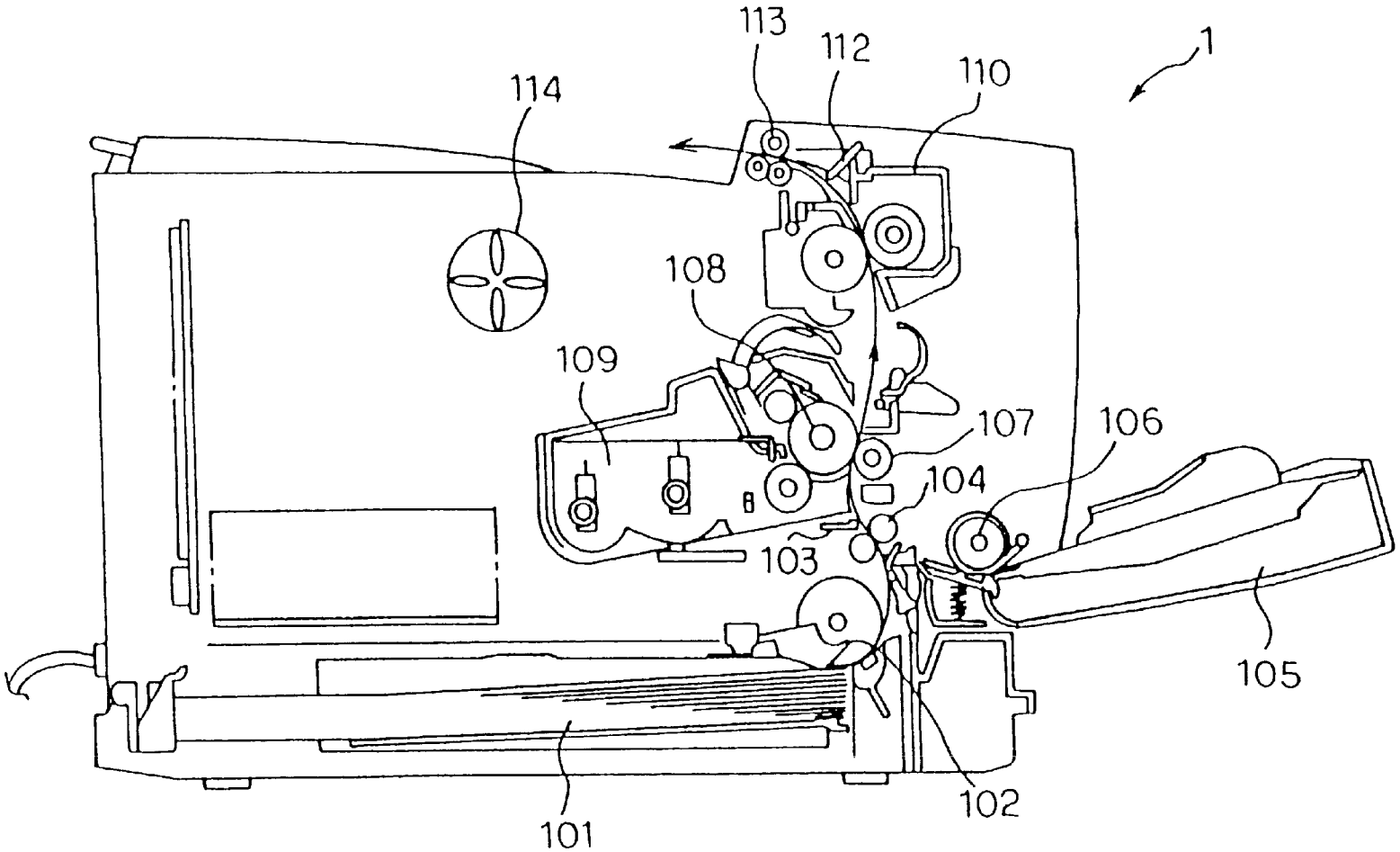
FIG. 2 is a cross-sectional view of an electrophotographic printer as an image-forming device according to a first embodiment of the present invention provided with a conveyance path.

FIG. 2 is a cross-sectional view of an electrophotographic printer as an image-forming device according to a first embodiment of the present invention provided with a conveyance path.

In FIG. 2, an image-forming device (a laser printer) 1 is connected to a host device (not shown in FIG. 2; corresponding to a host device 16 shown in FIG. 4) via an interface so as to form a communication system.

Upon the occurrence of an image-formation request in the host device, etc., a main feed roller 102 is driven so as to move a transfer paper (a transfer sheet) one by one toward a conveying direction, the transfer paper being provided in a main feed device 101. When the transfer paper reaches a resist roller 104, the transfer paper is temporarily halted. In a case where the transfer paper is fed from a manual feed device 105, the transfer paper is conveyed via a manual feed roller 106, and is temporarily halted by the resist roller 104. Thereafter, when a control unit (corresponding to a controller 2 shown in FIG. 4) issues a resist-roller drive start request, the resist roller 104 is driven so as to move the transfer paper in the conveying direction. Subsequently, in a developing device 109, a toner is applied to a photosensitive member 108 so as to form a toner image of a subject copy on the photosensitive member 108. Then, the toner is applied to the transfer paper by a transfer roller 107.

In order to fix the toner applied to the transfer paper, the transfer paper is moved to a fixing device 110, and is subjected to a heat/pressure treatment. Thereafter, when the leading end of the transfer paper reaches a delivery sensor 112, the delivery sensor turns on. Subsequently, when the trailing end of the transfer paper passes the delivery sensor 112, the delivery sensor turns off. Then, the transfer paper is delivered out via a delivery roller 113, completing an image formation of one transfer paper. In this course, in a case where an image formation is performed with a resolution necessitating a slow linear velocity for example, if a cooling fan 114 keeps revolving from the start of driving the resist roller 104 until the transfer paper reaching the delivery sensor 112, the transfer paper is possibly torn due to an air current generated by the cooling fan 114 while the leading end of the transfer paper is moved from the resist roller 104 to the delivery sensor 112; in this case, toner particles applied on the transfer paper flow on the transfer paper, causing blurred images or creases in the transfer paper.

In the present embodiment, in order to prevent these blurred images or creases in the transfer paper, the cooling fan 114 is stopped revolving while the leading end of the transfer paper is moved from the resist roller 104 to the delivery sensor 112, in the above-mentioned case where the image formation is performed with a resolution necessitating a slow linear velocity for example, or in other cases including a case where an image formation is performed by using a transfer paper thinner than a normal transfer paper having a predetermined thickness (or weight).

Next, a description will be given of a structure of the control unit of the image-forming device (the laser printer) 1.

Figure 3:
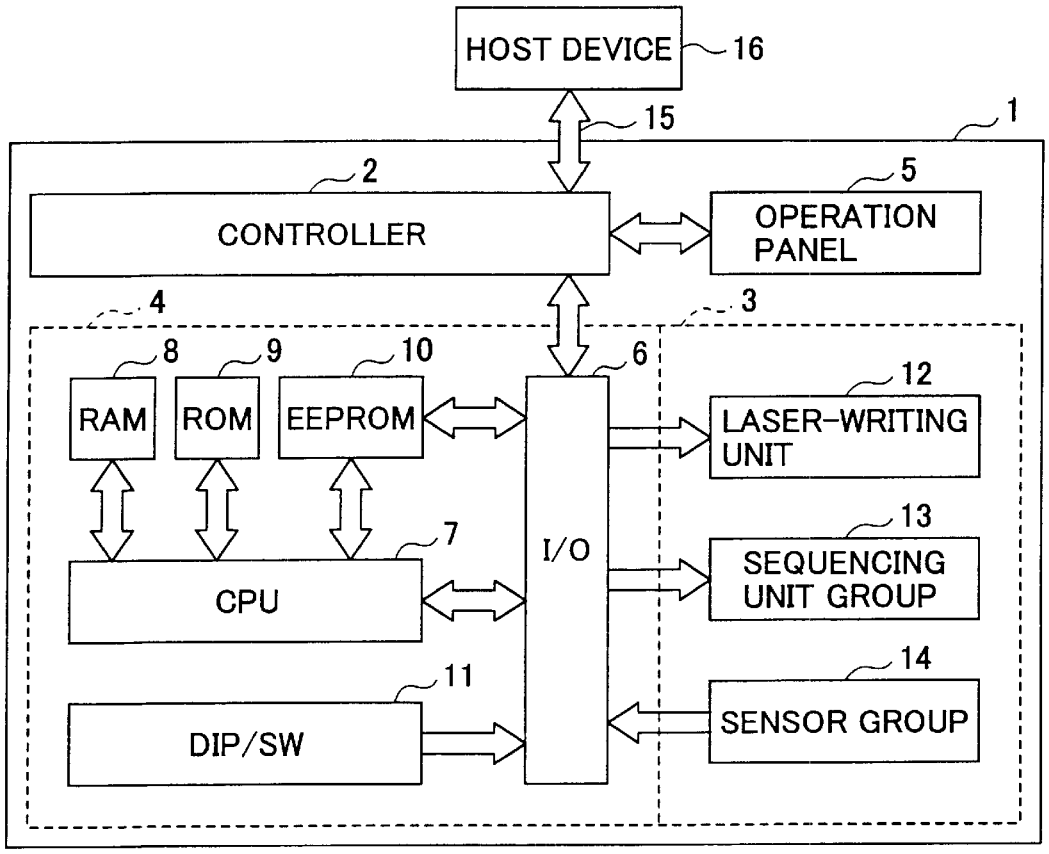
FIG. 3 is a block diagram of an image-forming system according to the first embodiment of the present embodiment.

As shown in FIG. 3, a main unit of the laser printer 1 (hereinafter referred to as main unit 1) is connected with the host computer (the host device) 16 via an I/O interface 15 provided between the controller 2 and the host device 16 so as to form a communication system in which the main unit 1 and the host device 16 exchange requested data and control signals therebetween.

The main unit 1 of the laser printer comprises the controller 2 performing an image processing, an image-formation engine 3, an engine control board 4 controlling the engine 3, and an operation panel 5 used for providing settings of various modes and an operation start instruction, etc. The controller 2, the image-formation engine 3 and the engine control board 4 exchange signals via an I/O interface (I/O) 6 of the engine control board 4.

The engine 3 comprises a laser-writing unit 12 including an LD and a polygon motor, a sequencing unit group 13 conducting an engine sequence of a fixing system, a developing system and a driving system, and a sensor group 14 checking conditions on a paper path and conditions of the engine sequence.

The engine control board 4 comprises a CPU 7, a RAM 8, a ROM 9, a nonvolatile memory (EEPROM) 10, and a dip switch (DIP-SW) 11. The CPU 7 controls the engine 3 as a whole according to programs stored in the program ROM 9, mode instructions from the operation panel 5, and commands from the controller 2 (and accompanying necessary information). The RAM 8 is used as a work memory of the CPU 7 or as an input buffer for input data. The ROM 9 stores the above-mentioned programs for controlling the engine 3. The nonvolatile memory (EEPROM) 10 stores information, such as error history of the engine 3 and contents of the mode instructions from the operation panel 5. The dip switch (DIP-SW) 11 is used for setting a mode of the engine control. The cooling-fan control of the present embodiment is performed in the CPU 7 controlling the engine 3.

Next, a description will be given of a structure of the above-mentioned controller 2.

Figure 4:
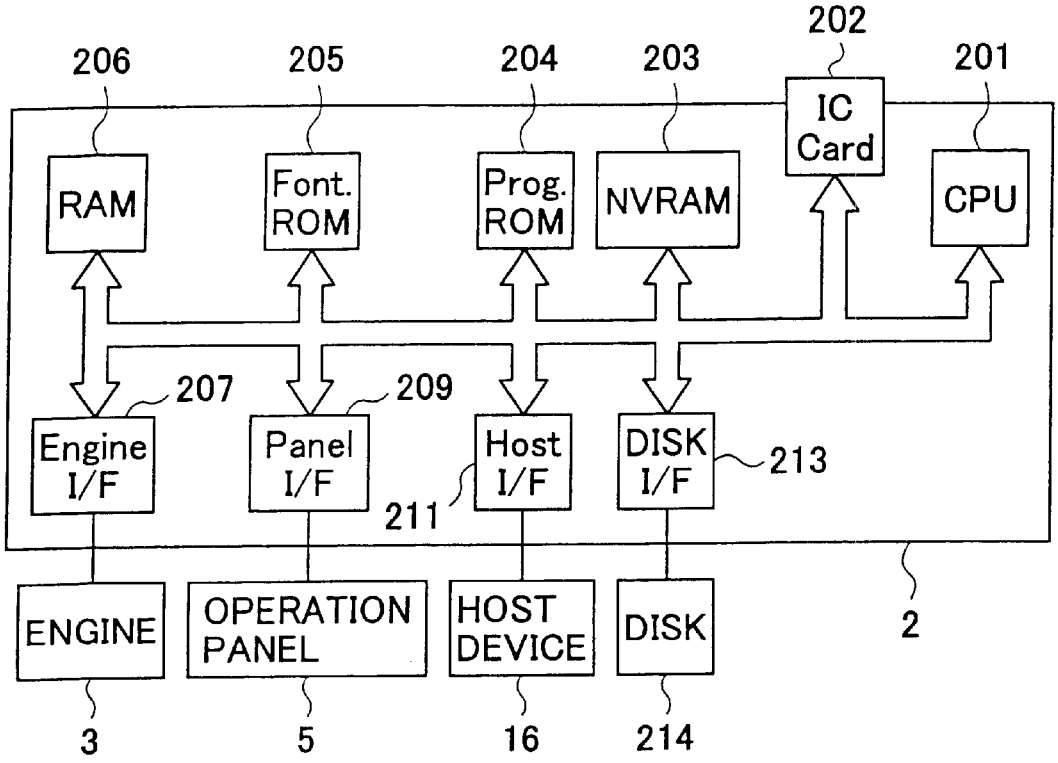
FIG. 4 is a block diagram of a controller of the image-forming device according to the first embodiment of the present invention.

In FIG. 4, a CPU 201 controls the controller 2 as a whole according to programs stored in a programmable ROM (Prog.ROM) 204, the mode instructions from the operation panel 5, and commands from the host device 16. An IC card reader (IC Card) 202 is used for reading font data and programs from an IC card. A nonvolatile memory (NVRAM) 203 stores information, such as contents of the mode instructions from the operation panel 5. The programmable ROM 204 stores the above-mentioned programs for controlling the controller 2. A font ROM (Font.ROM) 205 stores data, such as font pattern data. A RAM 206 is used as a work memory of the CPU 201, as an input buffer for input data, as a page buffer for print data, or as a memory for download fonts. Additionally, a timer not shown in the figure measures a current time, and is utilized for measuring times, such as a conveying time of the transfer paper.

An engine interface (Engine I/F) 207 communicates commands, statuses, and print data with the engine 3. The engine 3 has the above-described structure, and performs an actual printing. A panel interface (Panel I/F) 209 communicates commands and statuses with the operation panel 5. The operation panel 5 comprises a key group including a numeric keypad and a start key, and a display, such as an LCD, which are not shown in the figures. The operation panel 5 is used for informing a user of current conditions of the printer, and also is used by a user to provide the mode instructions. A host interface 211 enables a communication with the host device 16. Normally, the host interface 211 is formed by a Centronics interface or an RS232C, etc. The host device 16 hosts the laser printer 1, and includes a CPU, memories such as a RAM and a ROM, and an input-output device, which are not shown in the figures. A disk interface (DISK I/F) 213 enables a communication with a disk device (DISK) 214. The disk device 214 stores font data, programs, and various data, such as print data, and is formed by a floppy disk device or a hard disk device, etc.

Figure 5:
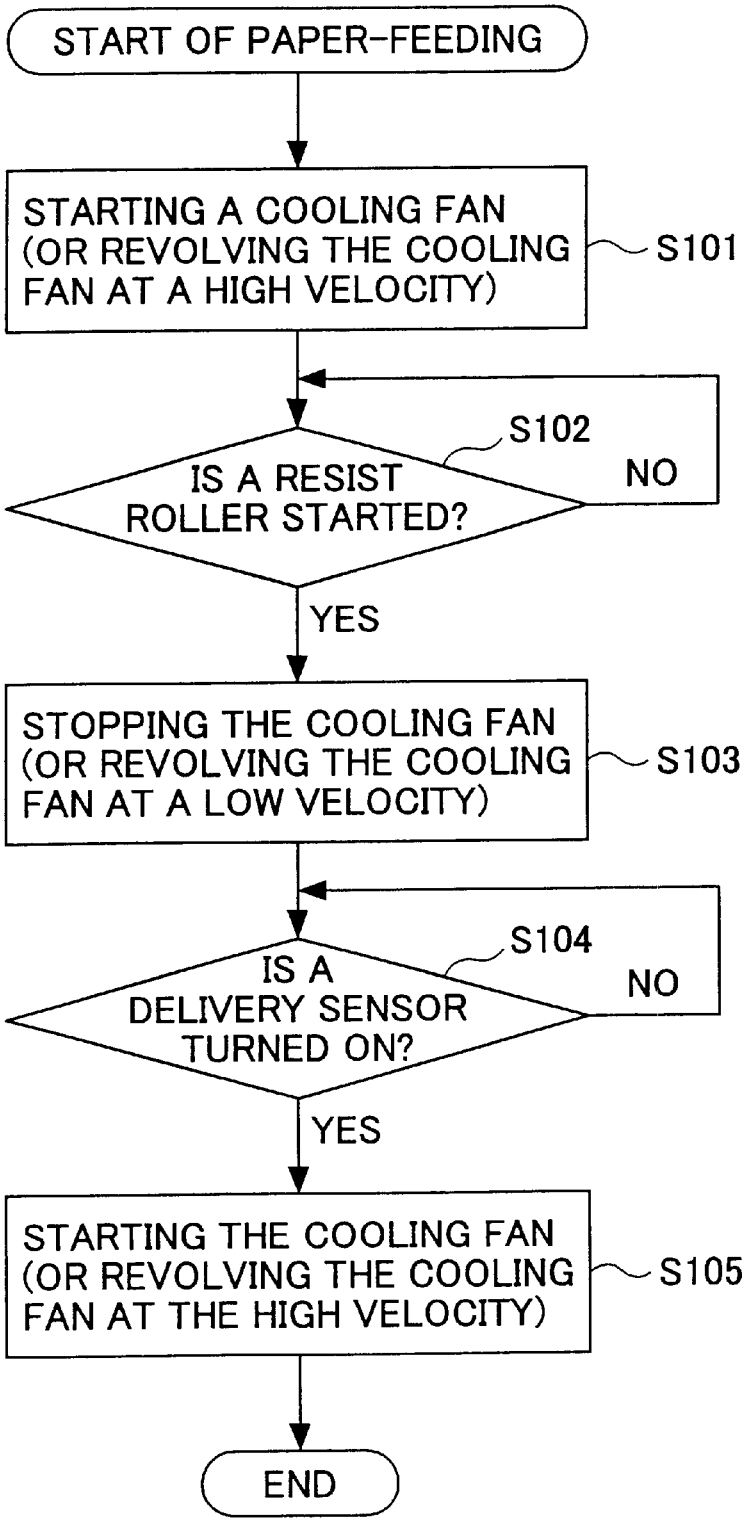
FIG. 5 is a flowchart of a method for controlling a cooling fan according to the first embodiment of the present invention.
Figure 6:
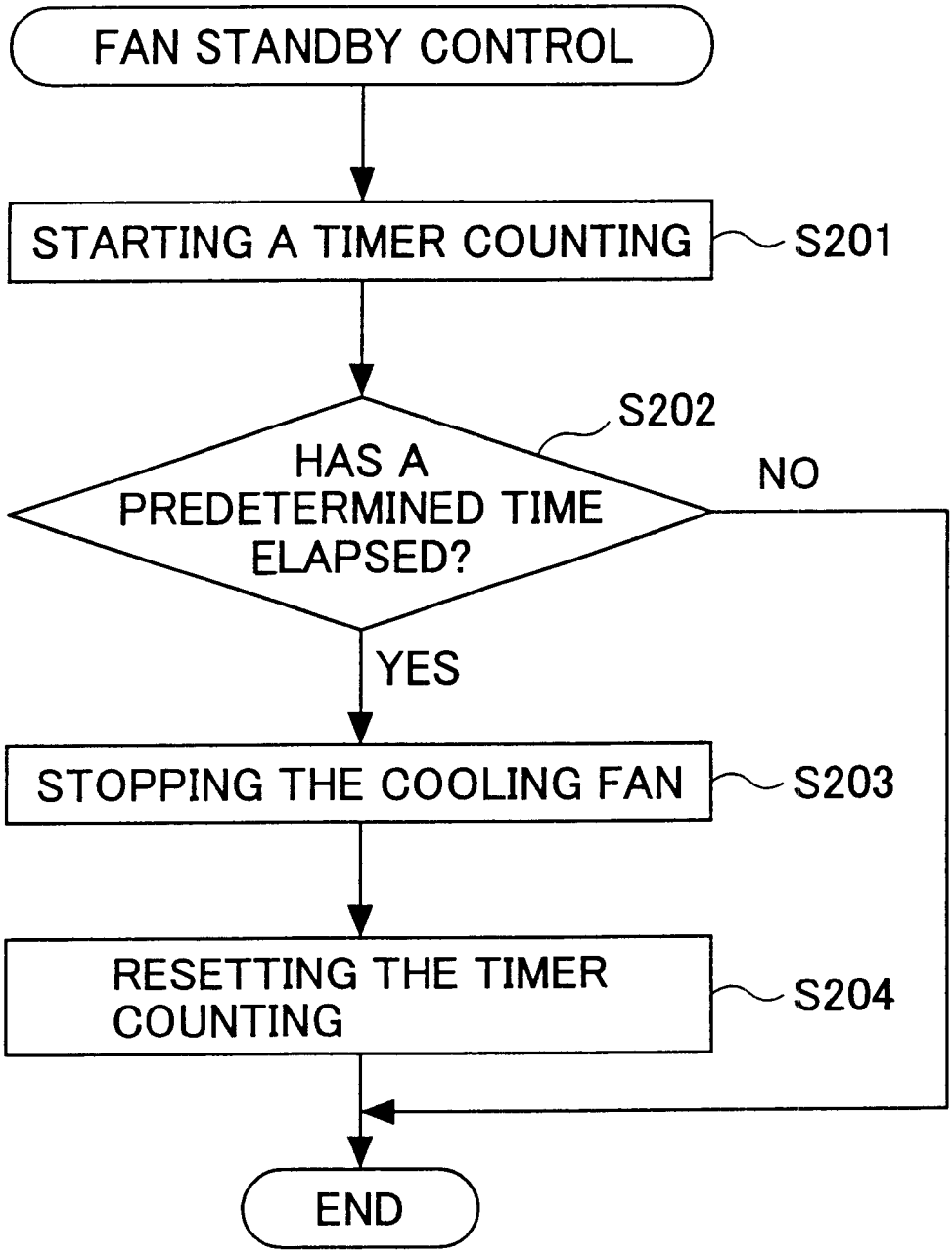
FIG. 6 is a flowchart of a method for a fan standby control according to the first embodiment and the following second to eighth embodiments of the present invention.

Next, a description will be given, with reference to FIG. 5 and FIG. 6, of a method for controlling the cooling fan according to the present embodiment.

First, when a print request is transmitted from the host device 16 to the laser printer 1, the controller 2 receives this print request, and informs the engine 3 of the print request. Thereby, the engine 3 commences a paper-feeding operation, and further begins a printing operation. Specifically, at the start of feeding a transfer paper, the cooling fan 114 is started in operation (S101 in FIG. 5). Then, when the leading end of the transfer paper fed from the main feed device 101 is detected by a resist sensor 103 (shown in FIG. 2), and a resist clutch (CL) is turned on for transmitting a driving force that revolves the resist roller 104 (YES in S102), the cooling fan is stopped revolving (S103). Thus, the cooling fan 114 is inhibited from generating an air current. Thereafter, when the leading end of the transfer paper reaches the delivery sensor 112 such that the delivery sensor 112 turns on (YES in S104), the cooling fan 114 is restarted into operation (S105).

In place of stopping the cooling fan 114 in a period from the transfer paper reaching the resist sensor 103 until the transfer paper reaching the delivery sensor 112 (including at least an interval from an exit of a transferring device comprising the transfer roller 107 and the photosensitive member 108 to an entrance of the fixing device 110), the cooling fan 114 may be revolved at a lower velocity than a velocity at the start of feeding the transfer paper. Also, in place of restarting the cooling fan 114 after the leading end of the transfer paper reaches the delivery sensor 112, the revolving velocity of the cooling fan 114 may be returned to the velocity (a high velocity) at the start of feeding the transfer paper.

Thus, the transfer paper is conveyed through while the start/restart or the revolving velocity of the cooling fan 114 is controlled according to a position of the transfer paper being conveyed. Besides, FIG. 6 shows a fan standby control performed after completion of the delivery of the transfer paper. In the fan standby control, as shown in FIG. 6, after completion of the delivery of the transfer paper, a timer counting is started when the cooling fan 114 starts standing by (S201). Thereafter, when a predetermined time has elapsed (YES in S202), the cooling fan 114 is stopped (S203), and the timer counting is reset (S204).

As described above, the image-forming device according to the first embodiment of the present invention comprises the CPU 7 in the main unit 1 of the laser printer: upon feeding a transfer paper, the CPU 7 starts the cooling fan 114 or revolves the cooling fan 114 at a predetermined velocity; then, while the leading end of the transfer paper moves from the resist roller 104 to the delivery sensor 112 (in a period from the resist clutch (CL) being turned on to the delivery sensor 112 turning on), the CPU 7 stops the cooling fan 114 or revolves the cooling fan 114 at a lower velocity than a velocity at the start of feeding the transfer paper; and upon the delivery of the transfer paper, the CPU 7 restarts the cooling fan 114 or returns the revolving velocity of the cooling fan 114 to the velocity at the start of feeding the transfer paper. This eliminates the above-mentioned inconveniences of blurred images or creases in the transfer paper, while preventing the reduction of cooling effects of the cooling fan according to positions of the transfer paper being conveyed.

Embodiment 2

Figure 7:
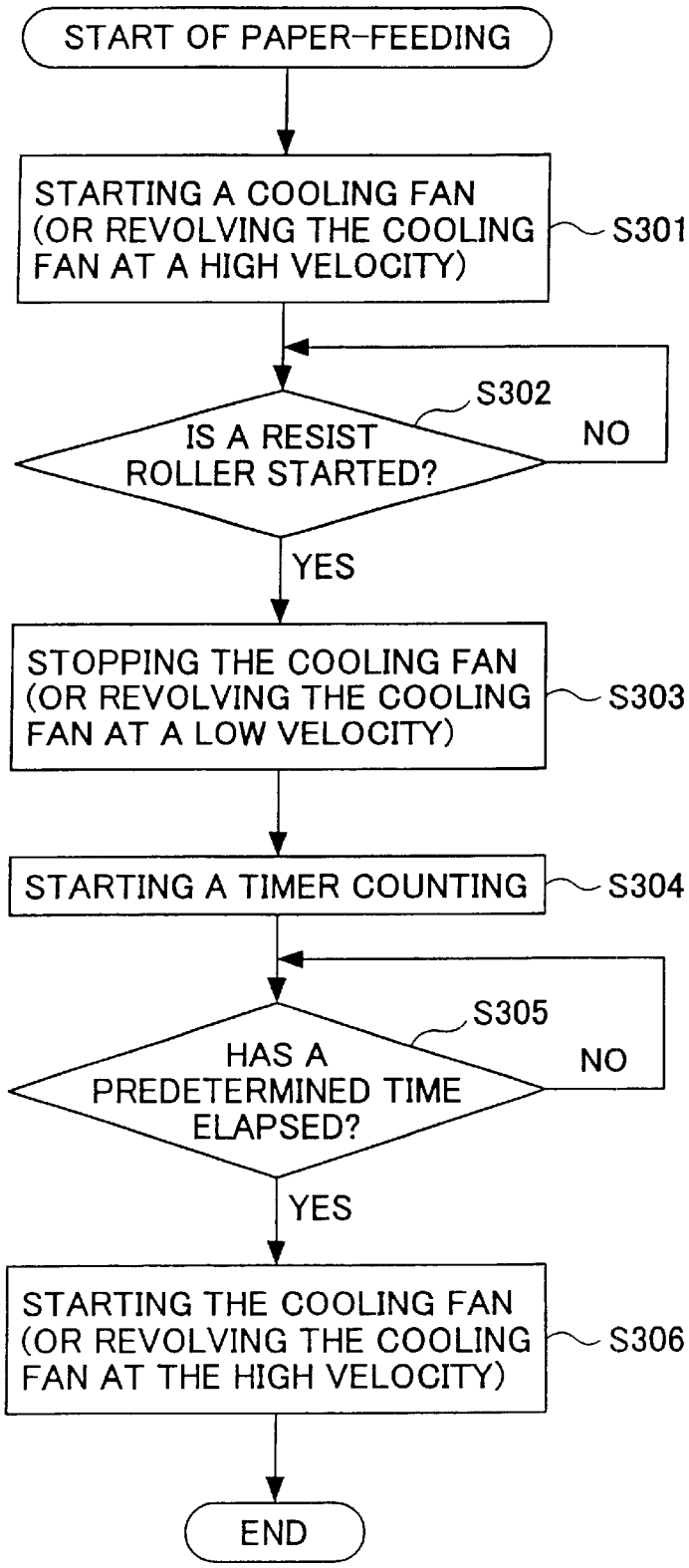
FIG. 7 is a flowchart of a method for controlling the cooling fan according to a second embodiment of the present invention.

FIG. 7 is a flowchart of a method for controlling the cooling fan according to a second embodiment of the present invention. It is noted that, since the present second embodiment has a similar structure to the structure of the above-described first embodiment, the following description will be given with reference also to FIG. 2 to FIG. 4, in which identical elements and steps are referred to by the same reference marks and numbers, and will not be described in detail.

The difference of the present second embodiment from the first embodiment is as follows. Under the control of the CPU 7 in the main unit 1 of the laser printer, the cooling fan 114 is started upon feeding a transfer paper. Then, when the leading end of the transfer paper reaches the resist roller 104 (upon the resist clutch (CL) being turned on), the cooling fan 114 is stopped. Subsequently, a timing of the leading end of the transfer paper reaching the entrance of the fixing device 110 is calculated based on the distance (layout) from the resist roller 104 to the entrance of the fixing device 110 and a conveying velocity. According to this timing (after a predetermined time has elapsed), the cooling fan 114 is restarted. With this structure, the timing of the leading end of the transfer paper reaching the entrance of the fixing device 110 can be calculated by using an existing conveyance control sensor (e.g., the resist sensor), and according to this timing, a position of the transfer paper being conveyed is estimated so as to control the start/stop or the revolving velocity of the cooling fan 114. This eliminates the above-mentioned inconveniences of blurred images or creases in the transfer paper without increasing sensors and costs involved.

In the present second embodiment, a conveying time of the transfer paper is measured by the timer (mentioned in the first embodiment). Based on the result of this measurement, information detected by the sensor group 14, and a predetermined conveying velocity, a conveyed distance of the transfer paper is calculated so as to detect the timing of the leading end of the transfer paper reaching the entrance of the fixing device 110.

When a print request is transmitted from the host device 16 to the laser printer 1, the engine 3 commences a paper-feeding operation. At the start of feeding a transfer paper, the cooling fan 114 is started (S301 in FIG. 7). Then, when the leading end of the transfer paper fed from the main feed device 101 is detected by the resist sensor 103 such that the resist clutch (CL) is turned on (YES in S302), the cooling fan is stopped revolving (S303). Thus, the cooling fan 114 is inhibited from generating an air current, and a timer counting is started (S304). Thereafter, when a predetermined time has elapsed (YES in S305), the cooling fan 114 is restarted (S306). In this course, the above-mentioned time (used in S305) is preliminarily determined by calculating the timing of the leading end of the transfer paper reaching the entrance of the fixing device 110, based on the distance (layout) from the resist sensor 103 to the entrance of the fixing device 110 and the conveying velocity.

In place of stopping the cooling fan 114 during the predetermined time from the point at which the transfer paper reaches the resist sensor 103, the cooling fan 114 may be revolved at a lower velocity than a velocity at the start of feeding the transfer paper, and the revolving velocity of the cooling fan 114 may be returned to the velocity at the start of feeding the transfer paper when the predetermined time has elapsed.

As described above, the transfer paper is conveyed through while the start/restart or the revolving velocity of the cooling fan 114 is controlled according to a distance of the transfer paper being conveyed from a predetermined position (e.g., a resist position). The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204).

Embodiment 3

Figure 8:
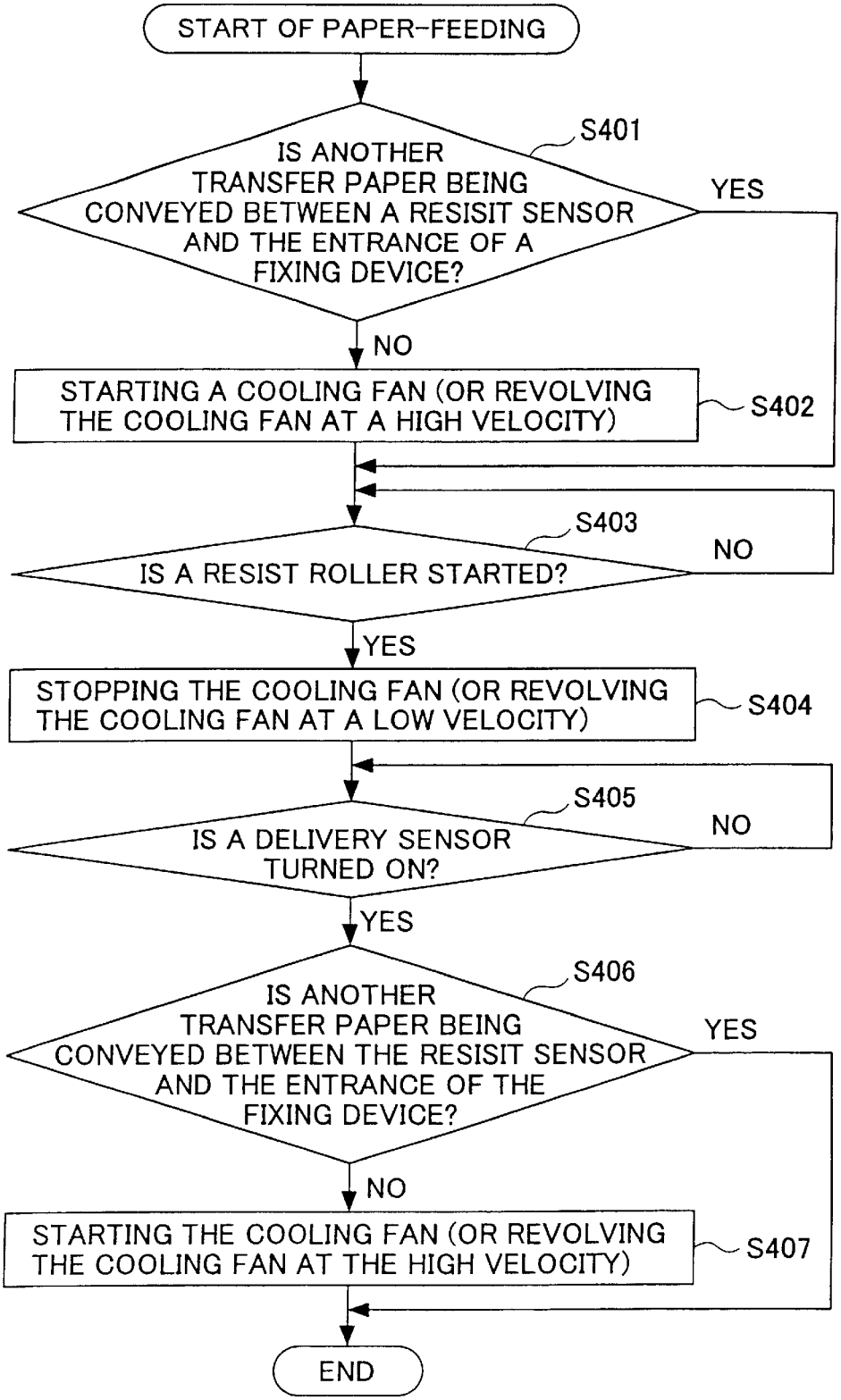
FIG. 8 is a flowchart of a method for controlling the cooling fan according to a third embodiment of the present invention.

FIG. 8 is a flowchart of a method for controlling the cooling fan according to a third embodiment of the present invention. It is noted that, since the present third embodiment has a similar structure to the structure of the above-described first embodiment, the following description will be given with reference also to FIG. 2 to FIG. 4, in which identical elements and steps are referred to by the same reference marks and numbers, and will not be described in detail.

The difference of the present third embodiment from the first embodiment is as follows. Under the control of the CPU 7 in the main unit 1 of the laser printer, the cooling fan 114 is started if another transfer paper (a second transfer paper) is not being conveyed between the resist sensor 103 and the delivery sensor 112 upon feeding a first transfer paper. If the second transfer paper is being conveyed therebetween, the cooling fan 114 is stopped revolving while the leading end of the second transfer paper moves from the resist roller 104 to the delivery sensor 112 (in a period from the resist clutch (CL) being turned on to the delivery sensor 112 turning on). Subsequently, after the delivery of the second transfer paper, it is again judged whether or not still another transfer paper (a third transfer paper) is being conveyed between the resist sensor 103 and the delivery sensor 112, and if the third transfer paper is not being conveyed therebetween, the cooling fan 114 is restarted. With this structure, the cooling fan 114 is exclusively controlled in consideration to a transfer paper being conveyed between the transferring device and the fixing device when a plurality of transfer papers are being conveyed through the laser printer 1. This eliminates the above-mentioned inconveniences of blurred images or creases in the transfer paper, even when a continuous printing is performed.

The CPU 7 in the laser printer 1 according to the present third embodiment performs multitask/multithread operations, and executes from feeding to delivering of one transfer paper as one process. Therefore, when a plurality of transfer papers exist in the device, one process shown in FIG. 8 is executed concurrently with other processes shown in FIG. 8. For example, when a process regarding a preceding transfer paper A performs a thread of step S401 shown in FIG. 8, a process regarding a following transfer paper B can perform a thread of the step S401.

Next, a description will be given, with reference to FIG. 8, of the above-mentioned one process.

When a print request is transmitted from the host device 16 to the laser printer 1, the engine 3 starts feeding a transfer paper. When another transfer paper is not being conveyed between the resist sensor 103 and the entrance of the fixing device 110 (NO in S401), the cooling fan 114 is started (S402). Then, when the leading end of the present transfer paper is detected by the resist sensor 103 such that the resist clutch (CL) is turned on (YES in S403), the cooling fan is stopped revolving (S404). Thus, the cooling fan 114 is inhibited from generating an air current. Thereafter, when the leading end of the transfer paper reaches the delivery sensor 112 such that the delivery sensor 112 turns on (YES in S405), and further when another transfer paper is not being conveyed between the resist sensor 103 and the entrance of the fixing device 110 (NO in S406), the cooling fan 114 is restarted into operation (S407).

On the other hand, when another transfer paper is being conveyed between the resist sensor 103 and the entrance of the fixing device 110 (YES in S401), the cooling fan 114 is not started. Further, when the leading end of the transfer paper is detected by the delivery sensor 112 (YES in S405), and when another transfer paper is being conveyed between the resist sensor 103 and the entrance of the fixing device 110 (YES in S406), the cooling fan 114 is not restarted/started into operation. This is the end of the process shown in FIG. 8.

In place of stopping (not starting/restarting) the cooling fan 114 when the leading end of another transfer paper exists between the resist sensor 103 and the entrance of the fixing device 110, the cooling fan 114 may be revolved at a lower velocity than a velocity at the start of feeding the transfer paper. Also in place of restarting the cooling fan 114, the revolving velocity of the cooling fan 114 may be returned to the velocity (a high velocity) at the start of feeding the transfer paper.

As described above, the transfer paper is conveyed through while the start/restart or the revolving velocity of the cooling fan 114 is controlled according to a position (a distance from the resist position) of the transfer paper being conveyed and whether or not the leading end of another transfer paper exists between the resist sensor 103 and the entrance of the fixing device 110. The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204).

Embodiment 4

Figure 9:
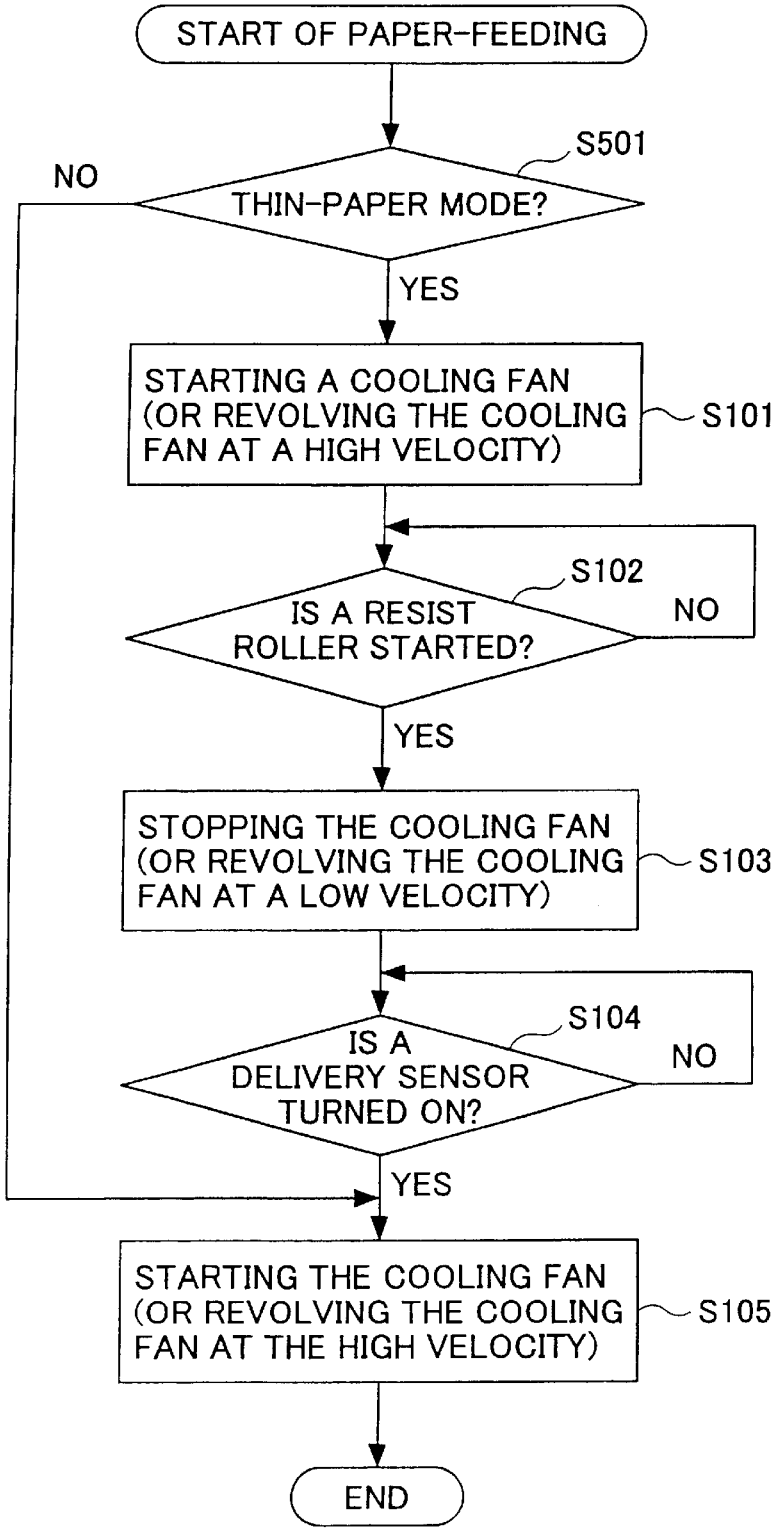
FIG. 9 is a flowchart of a method for controlling the cooling fan according to a fourth embodiment of the present invention.

FIG. 9 is a flowchart of a method for controlling the cooling fan according to a fourth embodiment of the present invention. It is noted that, since the present fourth embodiment has a similar structure to the structure of the above-described first embodiment, the following description will be given with reference also to FIG. 2 to FIG. 4, in which identical elements and steps are referred to by the same reference marks and numbers, and will not be described in detail.

The difference of the present fourth embodiment from the first embodiment is as follows. A thin-paper mode is set via the operation panel 5 (or from the host device 16) so as to use a transfer paper thinner than a predetermined thickness, and the CPU 7 controls the cooling fan 114 in a similar manner to the above-described first embodiment in the thin-paper mode. This structure can eliminate the above-mentioned inconveniences of blurred images or creases in the transfer paper, while preventing the reduction of cooling effects of the cooling fan in a predetermined period from the transferring process to the fixing process, only when using a transfer paper thinner than a predetermined thickness.

In the laser printer 1 having this structure, the above-mentioned thin-paper mode for using a transfer paper thinner than a predetermined thickness or a normal mode for using a transfer paper (a normal transfer paper) equal to or thicker than the predetermined thickness can be set by means of a key operation of the operation panel 5, etc. The setting is sent to the controller 2, and is stored updatably in the nonvolatile memory (NVRAM) 203. When the thin-paper mode is set in the controller 2, the CPU 7 controls the cooling fan 114 in a predetermined period from the transferring of an image to a transfer paper to the fixing thereof such that the CPU 7 stops the cooling fan 114 or revolves the cooling fan 114 at a lower velocity than a velocity at the start of feeding the transfer paper, and upon the delivery of the transfer paper, the CPU 7 restarts the cooling fan 114 or returns the revolving velocity of the cooling fan 114 to the velocity at the start of feeding the transfer paper.

Next, a description will be given, with reference to FIG. 9, of the method for controlling the cooling fan according to the present fourth embodiment.

When a print request is transmitted from the host device 16 to the laser printer 1, the controller 2 receives this print request, and informs the engine 3 of the print request according to a mode set in the nonvolatile memory (NVRAM) 203. Thereby, the engine 3 commences a paper-feeding operation, and further begins a printing operation. Specifically, in the thin-paper mode (YES in S501), at the start of feeding a transfer paper, the cooling fan 114 is started in operation (S101). Then, when the leading end of the transfer paper fed from the main feed device 101 is detected by the resist sensor 103 such that the resist clutch (CL) is turned on (YES in S102), the cooling fan is stopped revolving (S103). Thus, the cooling fan 114 is inhibited from generating an air current. Thereafter, when the leading end of the transfer paper reaches the delivery sensor 112 such that the delivery sensor 112 turns on (YES in S104), the cooling fan 114 is restarted into operation (S105). On the other hand, in the normal mode (NO in S501), the cooling fan 114 is continuously driven from the start of the feeding of the transfer paper to the completion of the delivery of the transfer paper (S105).

In the thin-paper mode, in place of stopping the cooling fan 114 in a period from the transfer paper reaching the resist sensor 103 until the transfer paper reaching the delivery sensor 112, the cooling fan 114 may be revolved at a lower velocity than a velocity at the start of feeding the transfer paper. Also, in place of restarting the cooling fan 114 after the transfer paper reaches the delivery sensor 112, the revolving velocity of the cooling fan 114 may be returned to the velocity at the start of feeding the transfer paper. Additionally, in the normal mode, the revolving velocity of the cooling fan 114 at the start of feeding the transfer paper may be maintained until the completion of the delivery of the transfer paper.

As described above, the transfer paper is conveyed through the laser printer 1, while the start/restart or the revolving velocity of the cooling fan 114 is controlled according to a position of the transfer paper being conveyed, only in the thin-paper mode using a transfer paper thinner than in the normal mode. The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204).

The present embodiment is not limited to the above-described example. The setting of the thin-paper/normal mode may be performed on the host side, and the mode information may be included in the print request transmitted from the host device 16 to the laser printer 1. In this case, the host device 16 comprises at least an operation/display unit (e.g., an input device, such as a keyboard, and an output device, such as a CRT) used to set the thin-paper/normal mode, and a nonvolatile memory (e.g., an NVRAM) updatably storing the setting of the mode.

Embodiment 5

Figure 10:
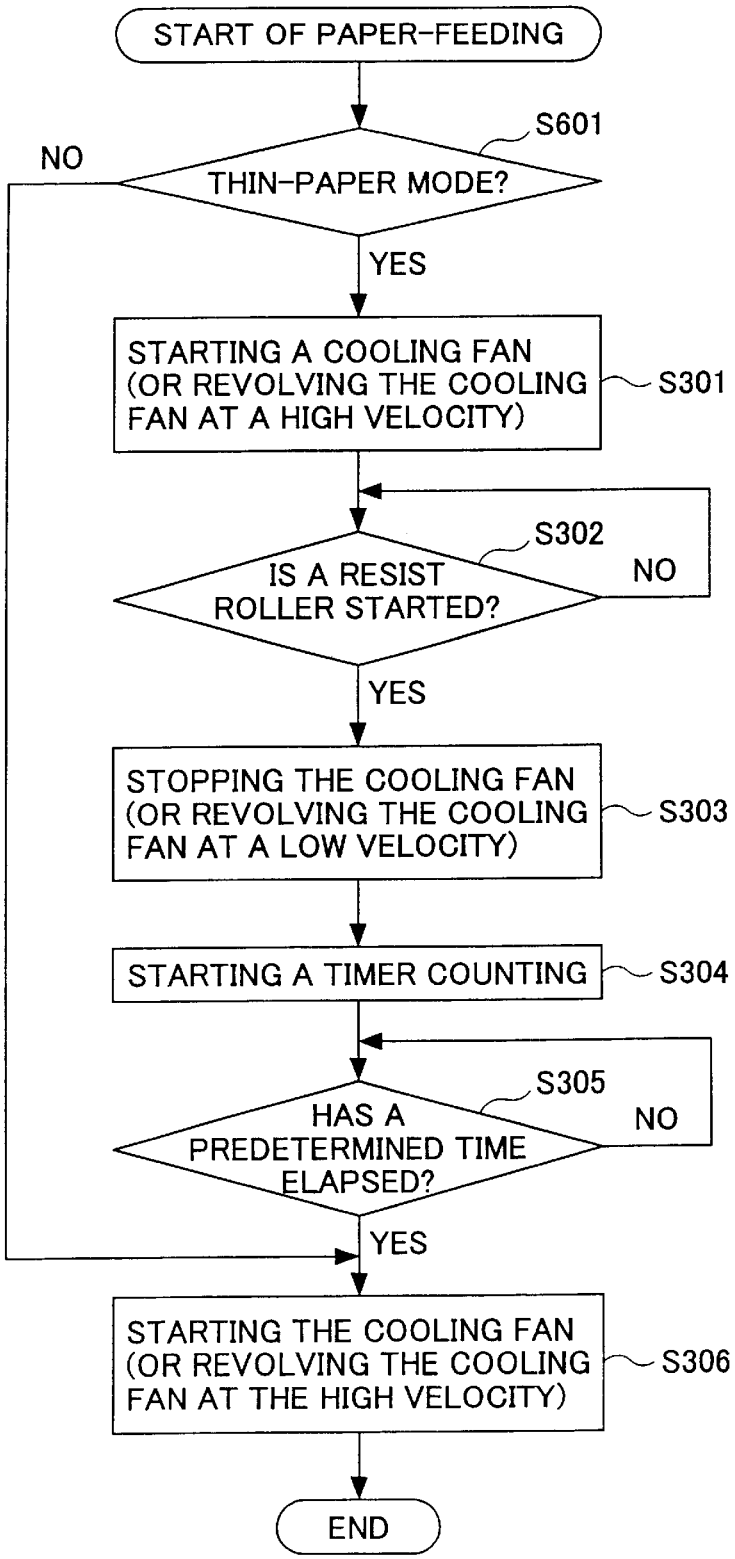
FIG. 10 is a flowchart of a method for controlling the cooling fan according to a fifth embodiment of the present invention.

FIG. 10 is a flowchart of a method for controlling the cooling fan according to a fifth embodiment of the present invention. It is noted that, since the present fifth embodiment has a similar structure to the structure of the above-described first embodiment, the following description will be given with reference also to FIG. 2 to FIG. 4, in which identical elements and steps are referred to by the same reference marks and numbers, and will not be described in detail.

The difference of the present fifth embodiment from the first embodiment is as follows. The thin-paper mode is set via the operation panel 5, etc., and the CPU 7 controls the cooling fan 114 in a similar manner to the above-described second embodiment, in the thin-paper mode. With this structure, only in the thin-paper mode, the timing of the leading end of the transfer paper reaching the entrance of the fixing device 110 is calculated by using the existing resist sensor, etc., and according to this timing, a position of the transfer paper being conveyed is estimated so as to control the start/stop or the revolving velocity of the cooling fan 114. This eliminates the above-mentioned inconveniences of blurred images or creases in the transfer paper without increasing sensors and costs involved, when using a transfer paper thinner than a predetermined thickness.

In the present fifth embodiment, a conveying time of the transfer paper is measured by the timer (mentioned in the first embodiment) of the laser printer 1. Based on the result of this measurement, information detected by the sensor group 14, and a predetermined conveying velocity, a conveyed distance of the transfer paper is calculated so as to detect the timing of the leading end of the transfer paper reaching the entrance of the fixing device 110. In addition, the above-mentioned thin-paper mode for using a transfer paper thinner than a predetermined thickness or the above-mentioned normal mode for using a normal transfer paper equal to or thicker than the predetermined thickness is set by means of a key operation via the operation panel 5, etc. This setting is sent to the controller 2, and is stored updatably in the nonvolatile memory (NVRAM) 203. When the thin-paper mode is set in the controller 2, the CPU 7 estimates a position of the transfer paper being conveyed according to the above-mentioned detected information and the result of the measurement by the above-mentioned timer, and controls the start/stop or the revolving velocity of the cooling fan 114 in a predetermined period from the transferring of an image to the transfer paper to the fixing thereof.

Next, a description will be given, with reference to FIG. 10, of the method for controlling the cooling fan according to the present fifth embodiment.

When a print request is transmitted from the host device 16 to the laser printer 1, the controller 2 receives this print request, and informs the engine 3 of the print request according to a mode set in the nonvolatile memory (NVRAM) 203. Thereby, the engine 3 commences a paper-feeding operation, and further begins a printing operation. Specifically, in the thin-paper mode (YES in S601), at the start of feeding a transfer paper, the cooling fan 114 is started in operation (S301). Then, when the leading end of the transfer paper fed from the main feed device 101 is detected by the resist sensor 103 such that the resist clutch (CL) is turned on (YES in S302), the cooling fan is stopped revolving (S303). Thus, the cooling fan 114 is inhibited from generating an air current, and a timer counting is started (S304). Thereafter, when a predetermined time has elapsed (YES in S305), the cooling fan 114 is restarted (S306). In this course, the above-mentioned time (used in S305) is preliminarily determined by calculating the timing of the leading end of the transfer paper reaching the entrance of the fixing device 110, based on the distance (layout) from the resist sensor 103 to the entrance of the fixing device 110 and the conveying velocity. On the other hand, in the normal mode (NO in S601), the cooling fan 114 is continuously driven from the start of the feeding of the transfer paper to the completion of the delivery of the transfer paper (S306).

In the thin-paper mode, in place of stopping the cooling fan 114 during the predetermined time from the point at which the transfer paper reaches the resist sensor 103, the cooling fan 114 may be revolved at a lower velocity than a velocity at the start of feeding the transfer paper, and the revolving velocity of the cooling fan 114 may be returned to the velocity at the start of feeding the transfer paper when the predetermined time has elapsed. Additionally, in the normal mode, the revolving velocity of the cooling fan 114 at the start of feeding the transfer paper may be maintained until the completion of the delivery of the transfer paper.

As described above, the transfer paper is conveyed through the laser printer 1, while the start/restart or the revolving velocity of the cooling fan 114 is controlled according to a distance of the transfer paper being conveyed from a predetermined position (e.g., the resist position), only in the thin-paper mode using a transfer paper thinner than in the normal mode. The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204).

The present embodiment is not limited to the above-described example. The setting of the thin-paper/normal mode may be performed on the host side, and the mode information may be included in the print request transmitted from the host device 16 to the laser printer 1. In this case, the host device 16 comprises at least an operation/display unit (e.g., an input device, such as a keyboard, and an output device, such as a CRT) used to set the thin-paper/normal mode, and a nonvolatile memory (e.g., an NVRAM) updatably storing the setting of the mode.

Embodiment 6

Figure 11:
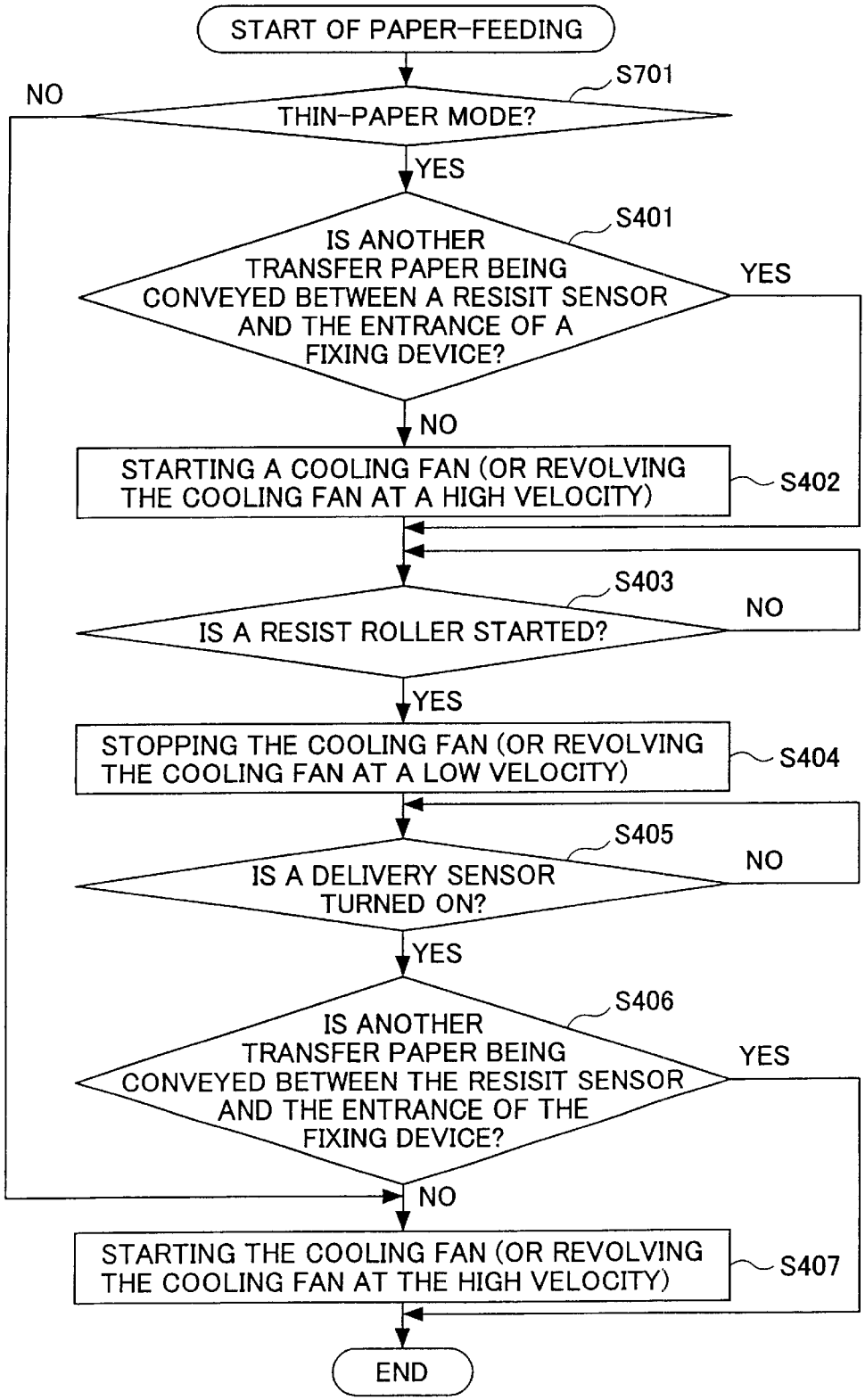
FIG. 11 is a flowchart of a method for controlling the cooling fan according to a sixth embodiment of the present invention.

FIG. 11 is a flowchart of a method for controlling the cooling fan according to a sixth embodiment of the present invention. It is noted that, since the present sixth embodiment has a similar structure to the structure of the above-described first embodiment, the following description will be given with reference also to FIG. 2 to FIG. 4, in which identical elements and steps are referred to by the same reference marks and numbers, and will not be described in detail.

The difference of the present sixth embodiment from the first embodiment is as follows. The thin-paper mode is set via the operation panel 5, etc., and the CPU 7 controls the cooling fan 114 in a similar manner to the above-described third embodiment, in the thin-paper mode. With this structure, only in the thin-paper mode, the cooling fan 114 is exclusively controlled in consideration to a transfer paper being conveyed between the transferring device and the fixing device when a plurality of transfer papers are being conveyed through the laser printer 1. This eliminates the above-mentioned inconveniences of blurred images or creases in the transfer paper, even when a continuous printing is performed.

In the present sixth embodiment, the above-mentioned thin-paper mode for using a transfer paper thinner than a predetermined thickness or the above-mentioned normal mode for using a normal transfer paper equal to or thicker than the predetermined thickness is set by means of a key operation via the operation panel 5 of the laser printer 1, etc. This setting is sent to the controller 2, and is stored updatably in the nonvolatile memory (NVRAM) 203. When the thin-paper mode is set in the controller 2, the CPU 7 estimates a position of the transfer paper being conveyed according to information detected by the sensors, and controls the start/restart or the revolving velocity of the cooling fan 114 in a predetermined period from the transferring of an image to the transfer paper to the fixing thereof. Additionally, when a plurality of transfer papers are being conveyed through the laser printer 1, the CPU 7 controls the cooling fan 114 exclusively in consideration to a transfer paper being conveyed between the transferring device and the fixing device.

The CPU 7 in the laser printer 1 according to the present sixth embodiment performs multitask/multithread operations, and executes from feeding to delivering of one transfer paper as one process. Therefore, when a plurality of transfer papers exist in the device, one process shown in FIG. 11 is executed concurrently with other processes shown in FIG. 11.

Next, a description will be given, with reference to FIG. 11, of the method (the above-mentioned one process) for controlling the cooling fan according to the present sixth embodiment.

When a print request is transmitted from the host device 16 to the laser printer 1, the controller 2 receives this print request, and informs the engine 3 of the print request according to a mode set in the nonvolatile memory (NVRAM) 203. Thereby, the engine 3 commences a paper-feeding operation, and further begins a printing operation. In the thin-paper mode (YES in S701), when another transfer paper is not being conveyed between the resist sensor 103 and the entrance of the fixing device 110 (NO in S401), the cooling fan 114 is started (S402). Then, when the leading end of the present transfer paper is detected by the resist sensor 103 such that the resist clutch (CL) is turned on (YES in S403), the cooling fan is stopped revolving (S404). Thus, the cooling fan 114 is inhibited from generating an air current. Thereafter, when the leading end of the transfer paper reaches the delivery sensor 112 such that the delivery sensor 112 turns on (YES in S405), and further when another transfer paper is not being conveyed between the resist sensor 103 and the entrance of the fixing device 110 (NO in S406), the cooling fan 114 is restarted into operation (S407).

Also in the thin-paper mode (YES in S701), when another transfer paper is being conveyed between the resist sensor 103 and the entrance of the fixing device 110 (YES in S401), the cooling fan 114 is not started. Further, when the leading end of the transfer paper is detected by the delivery sensor 112 (YES in S405), and when another transfer paper is being conveyed between the resist sensor 103 and the entrance of the fixing device 110 (YES in S406), the cooling fan 114 is not restarted/started into operation. This is the end of the process shown in FIG. 11.

On the other hand, in the normal mode (NO in S701), the cooling fan 114 is continuously driven from the start of the feeding of the transfer paper to the completion of the delivery of the transfer paper (S407).

In the thin-paper mode, in place of stopping (not starting/restarting) the cooling fan 114 when the leading end of another transfer paper exists between the resist sensor 103 and the entrance of the fixing device 110, the cooling fan 114 may be revolved at a lower velocity than a velocity at the start of feeding the transfer paper. Also in place of restarting the cooling fan 114, the revolving velocity of the cooling fan 114 may be returned to the velocity at the start of feeding the transfer paper. Additionally, in the normal mode, the revolving velocity of the cooling fan 114 at the start of feeding the transfer paper may be maintained until the completion of the delivery of the transfer paper.

As described above, the transfer paper is conveyed through the laser printer 1, while the start/restart or the revolving velocity of the cooling fan 114 is controlled according to a position (a distance from the resist position) of the transfer paper being conveyed and whether or not the leading end of another transfer paper exists between the resist sensor 103 and the entrance of the fixing device 110, only in the thin-paper mode using a transfer paper thinner than in the normal mode. The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204).

The present embodiment is not limited to the above-described example. The setting of the thin-paper/normal mode may be performed on the host side, and the mode information may be included in the print request transmitted from the host device 16 to the laser printer 1. In this case, the host device 16 comprises at least an operation/display unit (e.g., an input device, such as a keyboard, and an output device, such as a CRT) used to set the thin-paper/normal mode, and a nonvolatile memory (e.g., an NVRAM) updatably storing the setting of the mode.

Embodiment 7

Figure 12:
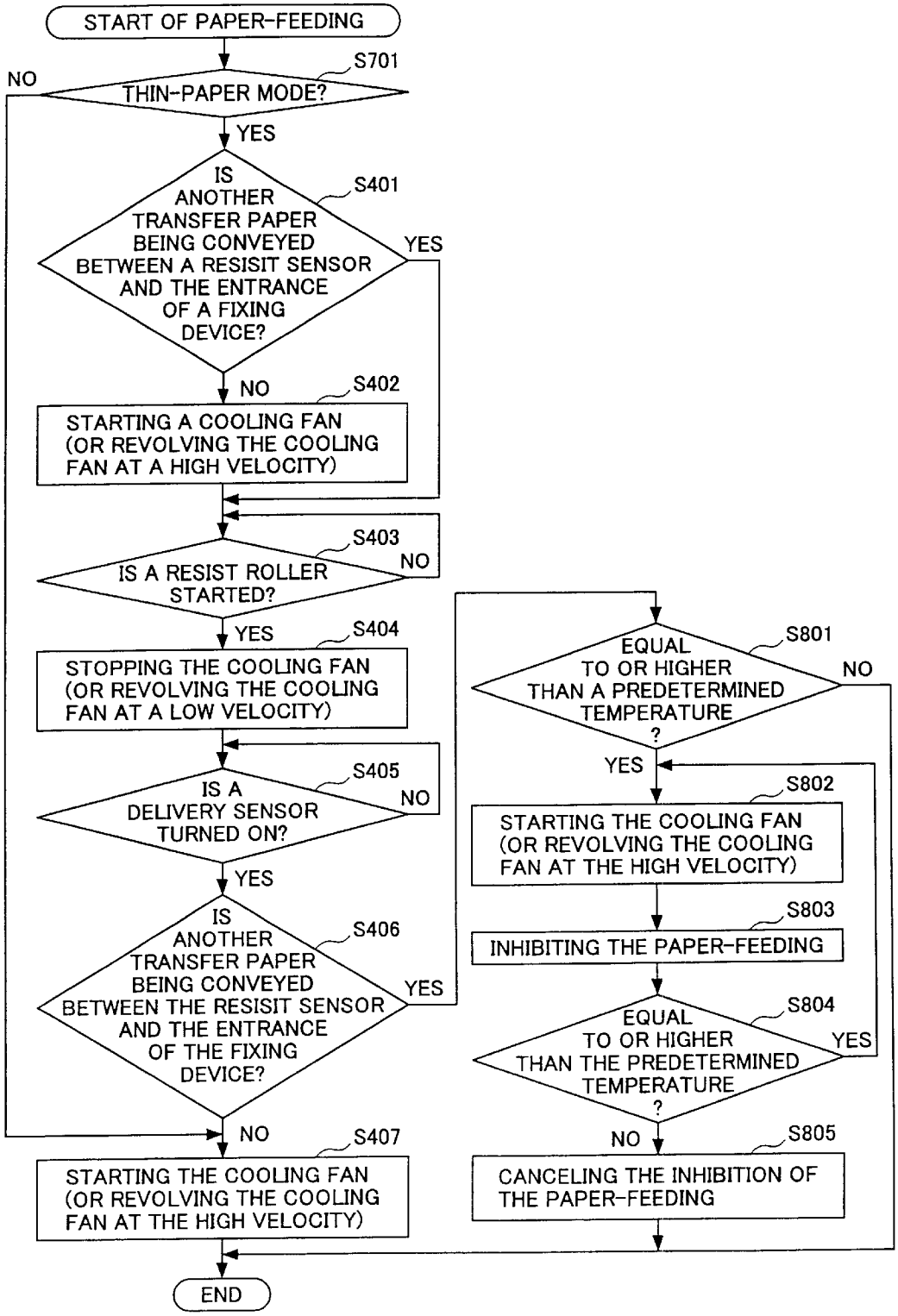
FIG. 12 is a flowchart of a method for controlling the cooling fan according to a seventh embodiment of the present invention.
Figure 13:
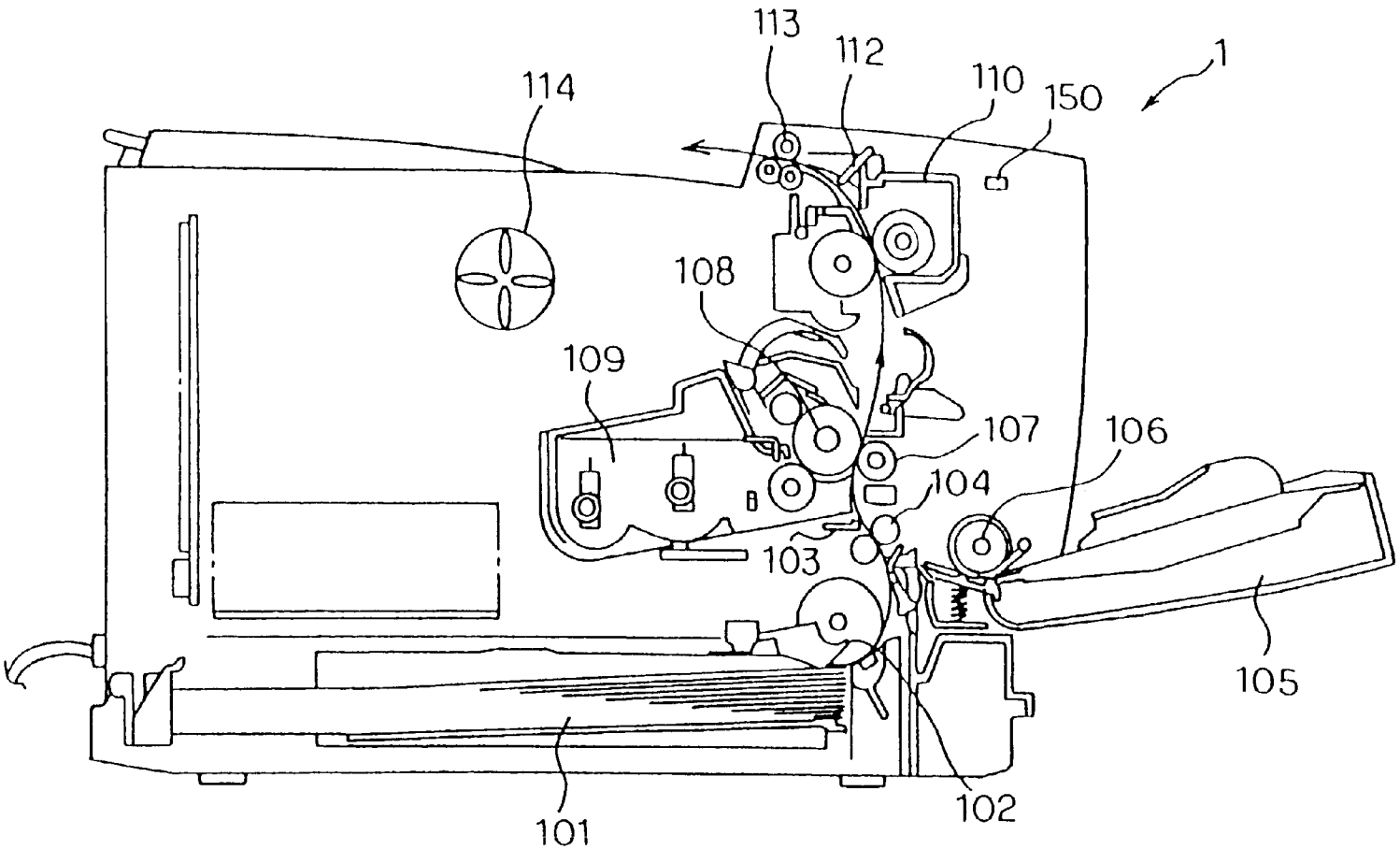
FIG. 13 is a cross-sectional view of an electrophotographic printer as an image-forming device according to a seventh embodiment of the present invention provided with a conveyance path.

FIG. 12 is a flowchart of a method for controlling the cooling fan according to a seventh embodiment of the present invention. FIG. 13 is a cross-sectional view of an electrophotographic printer as an image-forming device according to the seventh embodiment of the present invention provided with a conveyance path. It is noted that, since the present seventh embodiment has a similar structure to the structure of the above-described first embodiment, the following description will be given with reference also to FIG. 3 and FIG. 4, in which identical elements and steps are referred to by the same reference marks and numbers, and will not be described in detail.

The difference of the present seventh embodiment from the first embodiment is as follows. The laser printer 1 further comprises a temperature sensor 150, as shown in FIG. 13. The thin-paper mode is set via the operation panel 5, etc. The temperature sensor 150 senses a temperature in the laser printer 1. When a plurality of transfer papers are continuously fed in the thin-paper mode, the CPU 7 controls the cooling fan 114 in a similar manner to the above-described sixth embodiment. In this course, when the temperature in the laser printer 1 reaches a predetermined temperature, the CPU 7 starts the cooling fan 114, and halts the paper-feeding operation- In this structure, when the temperature in the laser printer 1 becomes equal to or higher than a predetermined temperature during a continuous printing in the thin-paper mode, the cooling fan 114 is started and the paper-feeding operation is inhibited. This not only eliminates the above-mentioned inconveniences of blurred images or creases in the transfer paper, but also maintains a proper temperature in the laser printer 1, when a plurality of transfer papers are being conveyed through the laser printer 1 in the thin-paper mode.

In the present seventh embodiment, the above-mentioned thin-paper mode for using a transfer paper thinner than a predetermined thickness or the above-mentioned normal mode for using a normal transfer paper equal to or thicker than the predetermined thickness is set by means of a key operation via the operation panel 5 of the laser printer 1, etc. This setting is sent to the controller 2, and is stored updatably in the nonvolatile memory (NVRAM) 203. When the thin-paper mode is set in the controller 2, the CPU 7 estimates a position of the transfer paper being conveyed according to information detected by the sensors, and controls the start/stop or the revolving velocity of the cooling fan 114 in a predetermined period from the transferring of an image to the transfer paper to the fixing thereof. Additionally, when a plurality of transfer papers are being conveyed through the laser printer 1, the CPU 7 controls the cooling fan 114 exclusively in consideration to a transfer paper being conveyed between the transferring device and the fixing device. In this course, when the temperature sensor 150 senses a temperature higher than a predetermined temperature, the CPU 7 restarts the cooling fan 114, and halts the paper-feeding operation. The temperature sensor 150 is included in the sensor group 14. The temperature sensor 150 senses an internal temperature of the laser printer 1, and informs the CPU 7 of the detected information (temperature information).

The CPU 7 in the laser printer 1 according to the present seventh embodiment performs multitask/multithread operations, and executes from feeding to delivering of one transfer paper as one process. Therefore, when a plurality of transfer papers exist in the device, one process shown in FIG. 12 is executed concurrently with other processes shown in FIG. 12.

Next, a description will be given, with reference to FIG. 12, of the method (the above-mentioned one process) for controlling the cooling fan according to the present seventh embodiment.

When a print request is transmitted from the host device 16 to the laser printer 1, the controller 2 receives this print request, and informs the engine 3 of the print request according to a mode set in the nonvolatile memory (NVRAM) 203. Thereby, the engine 3 commences a paper-feeding operation, and further begins a printing operation. In the thin-paper mode (YES in S701), when another transfer paper is not being conveyed between the resist sensor 103 and the entrance of the fixing device 110 (NO in S401), the cooling fan 114 is started (S402). Then, when the leading end of the present transfer paper is detected by the resist sensor 103 such that the resist clutch (CL) is turned on (YES in S403), the cooling fan is stopped revolving (S404). Thus, the cooling fan 114 is inhibited from generating an air current. Thereafter, when the leading end of the transfer paper reaches the delivery sensor 112 such that the delivery sensor 112 turns on (YES in S405), and further when another transfer paper is not being conveyed between the resist sensor 103 and the entrance of the fixing device 110 (NO in S406), the cooling fan 114 is restarted into operation (S407).

Also in the thin-paper mode (YES in S701), when another transfer paper is being conveyed between the resist sensor 103 and the entrance of the fixing device 110 (YES in S401), the cooling fan 114 is not started. Further, when the leading end of the transfer paper is detected by the delivery sensor 112 (YES in S405), and when another transfer paper is being conveyed between the resist sensor 103 and the entrance of the fixing device 110 (YES in S406), the controller 2 judges from the information detected by the temperature sensor 150 whether or not the temperature in the laser printer 1 is equal to or higher than a predetermined temperature (S801).

When the temperature in the laser printer 1 is equal to or higher than a predetermined temperature (YES in S801), the cooling fan 114 is started/restarted (S802), and the paper-feeding operation is inhibited (S803). Afterwards, when it is judged from the information detected by the temperature sensor 150 that the temperature in the laser printer 1 falls below the predetermined temperature (NO in S804), the inhibition of the paper-feeding operation is cancelled (S805).

On the other hand, in the normal mode (NO in S701), the cooling fan 114 is continuously driven from the start of the feeding of the transfer paper to the completion of the delivery of the transfer paper (S407).

In the thin-paper mode, in place of stopping (not starting/restarting) the cooling fan 114 when the leading end of another transfer paper exists between the resist sensor 103 and the entrance of the fixing device 110, the cooling fan 114 may be revolved at a lower velocity than a velocity at the start of feeding the transfer paper. Also in place of restarting the cooling fan 114, the revolving velocity of the cooling fan 114 may be returned to the velocity at the start of feeding the transfer paper. Additionally, in the normal mode, the revolving velocity of the cooling fan 114 at the start of feeding the transfer paper may be maintained until the completion of the delivery of the transfer paper.

As described above, the transfer paper is conveyed through the laser printer 1, while the start/restart or the revolving velocity of the cooling fan 114 is controlled according to a position (a distance from the resist position) of the transfer paper being conveyed, according to whether or not the leading end of another transfer paper exists between the resist sensor 103 and the entrance of the fixing device 110, and according to whether or not the temperature in the laser printer 1 is equal to or higher than a predetermined temperature, only in the thin-paper mode using a transfer paper thinner than in the normal mode. The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204). In the present embodiment, halting the paper-feeding operation elongates paper-feeding intervals, and thus decreases the number of papers fed per unit time; however, revolving the cooling fan 114 while halting the paper-feeding operation can restore a proper temperature in the laser printer 1 before feeding the next transfer paper, achieving sufficient cooling effects.

The present embodiment is not limited to the above-described example. The setting of the thin-paper/normal mode may be performed on the host side, and the mode information may be included in the print request transmitted from the host device 16 to the laser printer 1. In this case, the host device 16 comprises at least an operation/display unit (e.g., an input device, such as a keyboard, and an output device, such as a CRT) used to set the thin-paper/normal mode, and a nonvolatile memory (e.g., an NVRAM) updatably storing the setting of the mode.

Embodiment 8

Figure 14:
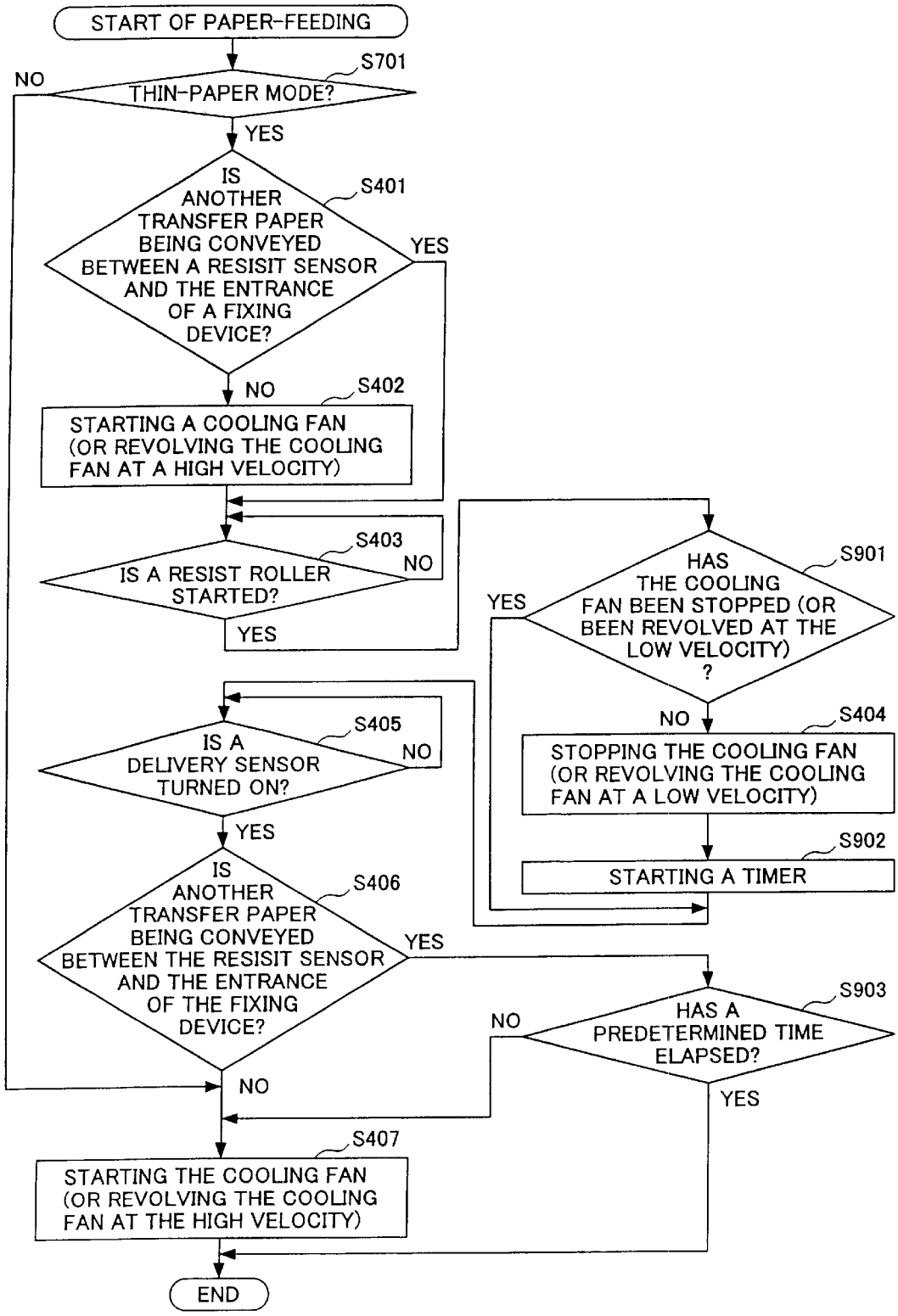
FIG. 14 is a flowchart of a method for controlling the cooling fan according to an eighth embodiment of the present invention.

FIG. 14 is a flowchart of a method for controlling the cooling fan according to an eighth embodiment of the present invention. It is noted that, since the present eighth embodiment has a similar structure to the structure of the above-described first embodiment, the following description will be given with reference also to FIG. 2 to FIG. 4, in which identical elements and steps are referred to by the same reference marks and numbers, and will not be described in detail.

The difference of the present eighth embodiment from the first embodiment is as follows. The thin-paper mode is set via the operation panel 5, etc. When a plurality of transfer papers are continuously fed in the thin-paper mode, the CPU 7 controls the cooling fan 114 in a similar manner to the above-described sixth embodiment. In this course, when a predetermined time or more has elapsed since the cooling fan 114 has been stopped, the CPU 7 starts the cooling fan 114. This not only eliminates the above-mentioned inconveniences of blurred images or creases in the transfer paper, but also maintains a proper temperature in the laser printer 1 during a continuous printing in the thin-paper mode.

In the present eighth embodiment, the above-mentioned thin-paper mode for using a transfer paper thinner than a predetermined thickness or the above-mentioned normal mode for using a normal transfer paper equal to or thicker than the predetermined thickness is set by means of a key operation via the operation panel 5 of the laser printer 1, etc. This setting is sent to the controller 2, and is stored updatably in the nonvolatile memory (NVRAM) 203. When the thin-paper mode is set in the controller 2, the CPU 7 estimates a position of the transfer paper being conveyed according to information detected by the sensors, and controls the start/restart or the revolving velocity of the cooling fan 114 in a predetermined period from the transferring of an image to the transfer paper to the fixing thereof. Additionally, when a plurality of transfer papers are being conveyed through the laser printer 1, the CPU 7 controls the cooling fan 114 exclusively in consideration to a transfer paper being conveyed between the transferring device and the fixing device. In this course, when a predetermined time or more has elapsed since the cooling fan 114 has been stopped, the CPU 7 forcibly restarts the cooling fan 114.

The CPU 7 in the laser printer 1 according to the present eighth embodiment performs multitask/multithread operations, and executes from feeding to delivering of one transfer paper as one process. Therefore, when a plurality of transfer papers exist in the device, one process shown in FIG. 14 is executed concurrently with other processes shown in FIG. 14.

Next, a description will be given, with reference to FIG. 14, of the method (the above-mentioned one process) for controlling the cooling fan according to the present eighth embodiment.

When a print request is transmitted from the host device 16 to the laser printer 1, the controller 2 receives this print request, and informs the engine 3 of the print request according to a mode set in the nonvolatile memory (NVRAM) 203. Thereby, the engine 3 commences a paper-feeding operation, and further begins a printing operation. In the thin-paper mode (YES in S701), when another transfer paper is not being conveyed between the resist sensor 103 and the entrance of the fixing device 110 (NO in S401), the cooling fan 114 is started (S402). Then, when the leading end of the present transfer paper is detected by the resist sensor 103 such that the resist clutch (CL) is turned on (YES in S403), the cooling fan is stopped revolving (S404). Thus, the cooling fan 114 is inhibited from generating an air current. Thereafter, when the leading end of the transfer paper reaches the delivery sensor 112 such that the delivery sensor 112 turns on (YES in S405), and further when another transfer paper is not being conveyed between the resist sensor 103 and the entrance of the fixing device 110 (NO in S406), the cooling fan 114 is restarted into operation (S407).

Also in the thin-paper mode (YES in S701), when another transfer paper is being conveyed between the resist sensor 103 and the entrance of the fixing device 110 (YES in S401), the cooling fan 114 is not started. Additionally, when the leading end of the present transfer paper is detected by the resist sensor 103 such that the resist clutch (CL) is turned on (YES in S403), it is judged whether or not the cooling fan 114 has been stopped (S901). When the cooling fan 114 has not been stopped (No in S901), the cooling fan 114 is stopped (S404), and then the timer (mentioned in the first embodiment) is started (S902). Further, when the leading end of the transfer paper is detected by the delivery sensor 112 (YES in S405), and when another transfer paper is being conveyed between the resist sensor 103 and the entrance of the fixing device 110 (YES in S406), it is judged from the measurement result (a counted value) of the timer whether or not a predetermined time has elapsed (S903). When the predetermined time has elapsed (YES in S903), the cooling fan 114 is restarted into operation (S407). Besides, the process shown in FIG. 14 is executed in multitask/multithread operations, as mentioned above, in which the counted value of the timer is shared among threads. Therefore, the counted value of the timer does not differ between a process of a transfer paper A and a process of a transfer paper B.

On the other hand, in the normal mode (NO in S701), the cooling fan 114 is continuously driven from the start of the feeding of the transfer paper to the completion of the delivery of the transfer paper (S407).

In the thin-paper mode, in place of stopping (not starting/restarting) the cooling fan 114 when the leading end of another transfer paper exists between the resist sensor 103 and the entrance of the fixing device 110, the cooling fan 114 may be revolved at a lower velocity than a velocity at the start of feeding the transfer paper. Also in place of restarting the cooling fan 114, the revolving velocity of the cooling fan 114 may be returned to the (high) velocity at the start of feeding the transfer paper. Additionally, in the normal mode, the revolving velocity of the cooling fan 114 at the start of feeding the transfer paper may be maintained until the completion of the delivery of the transfer paper.

As described above, the transfer paper is conveyed through the laser printer 1, while the start/restart or the revolving velocity of the cooling fan 114 is controlled according to a position (a distance from the resist position) of the transfer paper being conveyed, according to whether or not the leading end of another transfer paper exists between the resist sensor 103 and the entrance of the fixing device 110, and according to whether or not the predetermined time has elapsed, only in the thin-paper mode using a transfer paper thinner than in the normal mode. The fan standby control after completion of the delivery of the transfer paper is performed in the same manner as in the first embodiment shown in FIG. 6, in which a timer counting is started after completion of the delivery of the transfer paper (S201), and thereafter, when a predetermined time has elapsed (YES in S202), the cooling fan 114 is stopped (S203), and the timer counting is reset (S204). In the present embodiment, when the paper-feeding operation is halted, paper-feeding intervals are elongated, and thus the number of papers fed per unit time is decreased. However, sufficient cooling effects can be maintained.

The present embodiment is not limited to the above-described example. The setting of the thin-paper/normal mode may be performed on the host side, and the mode information may be included in the print request transmitted from the host device 16 to the laser printer 1. In this case, the host device 16 comprises at least an operation/display unit (e.g., an input device, such as a keyboard, and an output device, such as a CRT) used to set the thin-paper/normal mode, and a nonvolatile memory (e.g., an NVRAM) updatably storing the setting of the mode.

Additionally, in another example of the present embodiment, when the predetermined time has elapsed (YES in S903), the cooling fan 114 is restarted into operation, or the revolving velocity of the cooling fan 114 is returned to the high velocity (S407), as described above, and thereafter, when another predetermined time has elapsed in the controller 2, the cooling fan 114 may be stopped again or revolved at the lower velocity. This method can eliminate the above-mentioned inconveniences of blurred images or creases in the transfer paper, while maintaining a proper temperature in the laser printer 1 during a continuous printing in the thin-paper mode.

As described above, the control (the method for controlling the cooling fan) according to each of the above-mentioned embodiments is performed by the CPU 7 controlling the engine 3. Accordingly, programs downloaded form networks (such as a public network, a LAN, and the Internet) and programs read from a recording media such as a CD-ROM and an IC card are written to the above-mentioned ROM 9 storing programs for controlling the engine 3. In this case, the ROM 9 needs to be formed by an electrically erasable and rewritable element, such as a flash memory. Specifically, an IC card storing programs is inserted into the IC card reader 202, and the programs read therefrom may be written to the ROM 9 for the engine 3 via the engine interface 207.

Additionally, in the above-described embodiments, the timing to control the start/stop or the revolving velocity of the cooling fan 114 is detected according to information detected by the resist sensor 103 and the delivery sensor 112 in a period including at least the interval from the exit of the transferring device comprising the transfer roller 107 and the photosensitive member 108 to the entrance of the fixing device 110. However, the present invention is not limited to the above-described embodiments, and other sensors can be substituted for the sensors 103 and 112. For example, in FIG. 2, another sensor may be newly provided between the resist roller 104 and the transfer roller 107. In this structure, the newly provided sensor can detect a transfer paper at a position nearer to the transfer roller 107 than the resist sensor 103 does. This shortens the period in which the cooling fan 114 is stopped or is revolved at a lower velocity. As another example, the timing to control the start/stop or the revolving velocity of the cooling fan 114 may be detected according to an electromagnetic clutch (the resist clutch) provided on a driving axle of the resist roller 104 turning on or off. This method can stop the cooling fan 114 or revolve the cooling fan 114 at a lower velocity, immediately after the transferring, so as to keep the reduction of cooling effects as little as possible.

In the above-described embodiments, at least the transfer roller 107 and the photosensitive member 108 form transferring means. At least the fixing device 110 forms fixing means. At least the main feed device 101 and the resist roller 104 form feeding means. At least the resist sensor 103 and the delivery sensor 112 form conveyance-position detecting means. At least the controller 2 and the CPU 7 form controlling means. At least the above-mentioned timer forms timing means. At least the operation panel 5 (or the operation/display unit of the host device 16) forms mode-setting means. At least the temperature sensor 150 forms temperature-sensing means.

The present invention is not limited to the specifically disclosed embodiments, and variations and modifications may be made without departing from the scope of the present invention.

The present application is based on Japanese priority applications No. 2000-399947 filed on Dec. 28, 2000 and No. 2001-054726 filed on Feb. 28, 2001, the entire contents of which are hereby incorporated by reference.

What is claimed is:

1. An image-forming device comprising:

fixing means for fixing a toner visible image transferred to a transfer sheet;

feeding means for feeding and conveying the transfer sheet to said fixing means;

a cooling fan discharging a heat generated in said fixing means;

conveyance-position detecting means for detecting a conveyance position of the transfer sheet being conveyed; and controlling means for controlling said cooling fan to start and stop revolving according to said conveyance position;

wherein said feeding means continuously feeds and conveys a plurality of transfer sheets to said fixing means, and said controlling means controls said cooling fan to stop revolving when a preceding transfer sheet exists in a predetermined conveying range.

2. The image-forming device as claimed in claim 1, wherein said controlling means controls said cooling fan to stop revolving at least while the transfer sheet is conveyed from transferring means to said fixing means, the transferring means transferring said toner visible image to the transfer sheet.

3. The image-forming device as claimed in claim 2, further comprising temperature-sensing means for sensing a temperature in the image-forming device, wherein said controlling means controls said cooling fan to start revolving when said temperature-sensing means senses a temperature equal to or higher than a predetermined temperature.

4. The image-forming device as claimed in claim 2, wherein said controlling means controls said cooling fan to start revolving when a predetermined time elapses since said cooling fan has stopped revolving.

5. The image-forming device as claimed in claim 1, further comprising mode-setting means for setting a thin-sheet mode indicating that said transfer sheet is thinner than a predetermined thickness, wherein said controlling means controls said cooling fan to start and stop revolving according to said conveyance position in said thin-sheet mode.

6. An image-forming device comprising:

fixing means for fixing a toner visible image transferred to a transfer sheet;

feeding means for feeding and conveying the transfer sheet to said fixing means;

a cooling fan discharging a heat generated in said fixing means;

timing means for measuring a conveying time of the transfer sheet being conveyed; and controlling means for calculating a conveyance position of the transfer sheet being conveyed, based on said conveying time and a predetermined conveying velocity, so as to control said cooling fan to start and stop revolving according to said conveyance position;

wherein said feeding means continuously feeds and conveys a plurality of transfer sheets to said fixing means, and said controlling means controls said cooling fan to stop revolving when a preceding transfer sheet exists in a predetermined conveying range.

7. The image-forming device as claimed in claim 6, wherein said controlling means controls said cooling fan to stop revolving at least while the transfer sheet is conveyed from transferring means to said fixing means, the transferring means transferring said toner visible image to the transfer sheet.

8. The image-forming device as claimed in claim 7, further comprising temperature-sensing means for sensing a temperature in the image-forming device, wherein said controlling means controls said cooling fan to start revolving when said temperature-sensing means senses a temperature equal to or higher than a predetermined temperature.

9. The image-forming device as claimed in claim 7, wherein said controlling means controls said cooling fan to start revolving when a predetermined time elapses since said cooling fan has stopped revolving.

10. The image-forming device as claimed in claim 6, further comprising mode-setting means for setting a thin-sheet mode indicating that said transfer sheet is thinner than a predetermined thickness, wherein said controlling means controls said cooling fan to start and stop revolving according to said conveyance position in said thin-sheet mode.

11. An image-forming device comprising:

fixing means for fixing a toner visible image transferred to a transfer sheet;

feeding means for feeding and conveying the transfer sheet to said fixing means;

a cooling fan discharging a heat generated in said fixing means by revolving at a variable revolving velocity;

conveyance-position detecting means for detecting a conveyance position of the transfer sheet being conveyed; and controlling means for controlling the revolving velocity of said cooling fan according to said conveyance position;

wherein said feeding means continuously feeds and conveys a plurality of transfer sheets to said fixing means, and when a preceding transfer sheet exists in a predetermined conveying range, said controlling means controls said cooling fan to revolve at a revolving velocity lower than an initial revolving velocity upon the start of feeding the transfer sheets.

12. The image-forming device as claimed in claim 11, wherein said controlling means controls said cooling fan to revolve at a revolving velocity lower than said initial revolving velocity, at least while the transfer sheet is conveyed from transferring means to said fixing means, the transferring means transferring said toner visible image to the transfer sheet.

13. The image-forming device as claimed in claim 12, further comprising temperature-sensing means for sensing a temperature in the image-forming device, wherein said controlling means controls said cooling fan to revolve at said initial revolving velocity when said temperature-sensing means senses a temperature equal to or higher than a predetermined temperature.

14. The image-forming device as claimed in claim 12, wherein said controlling means controls said cooling fan to revolve at said initial revolving velocity when a predetermined time elapses since said cooling fan has been revolving at the revolving velocity lower than said initial revolving velocity.

15. The image-forming device as claimed in claim 11, further comprising mode-setting means for setting a thin-sheet mode indicating that said transfer sheet is thinner than a predetermined thickness, wherein said controlling means controls the revolving velocity of said cooling fan according to said conveyance position in said thin-sheet mode.

16. An image-forming device comprising:

fixing means for fixing a toner visible image transferred to a transfer sheet;

feeding means for feeding and conveying the transfer sheet to said fixing means;

a cooling fan discharging a heat generated in said fixing means by revolving at a variable revolving velocity;

timing means for measuring a conveying time of the transfer sheet being conveyed; and controlling means for calculating a conveyance position of the transfer sheet being conveyed, based on said conveying time and a predetermined conveying velocity, so as to control the revolving velocity of said cooling fan according to said conveyance position;

wherein said feeding means continuously feeds and conveys a plurality of transfer sheets to said fixing means, and when a preceding transfer sheet exists in a predetermined conveying range, said controlling means controls said cooling fan to revolve at a revolving velocity lower than an initial revolving velocity upon the start of feeding the transfer sheets.

17. The image-forming device as claimed in claim 16, wherein said controlling means controls said cooling fan to revolve at a revolving velocity lower than said initial revolving velocity, at least while the transfer sheet is conveyed from transferring means to said fixing means, the transferring means transferring said toner visible image to the transfer sheet.

18. The image-forming device as claimed in claim 17, further comprising temperature-sensing means for sensing a temperature in the image-forming device, wherein said controlling means controls said cooling fan to revolve at said initial revolving velocity when said temperature-sensing means senses a temperature equal to or higher than a predetermined temperature.

19. The image-forming device as claimed in claim 17, wherein said controlling means controls said cooling fan to revolve at said initial revolving velocity when a predetermined time elapses since said cooling fan has been revolving at the revolving velocity lower than said initial revolving velocity.

20. The image-forming device as claimed in claim 16, further comprising mode-setting means for setting a thin-sheet mode indicating that said transfer sheet is thinner than a predetermined thickness, wherein said controlling means controls the revolving velocity of said cooling fan according to said conveyance position in said thin-sheet mode.

21. A method for controlling an image-forming device including fixing means for fixing a toner visible image transferred to a transfer sheet, feeding means for feeding and conveying the transfer sheet to said fixing means, a cooling fan discharging a heat generated in said fixing means, and conveyance-position detecting means for detecting a conveyance position of the transfer sheet being conveyed, the method comprising:

detecting the conveyance position of the transfer sheet being conveyed;

controlling said cooling fan to start and stop revolving according to said conveyance position;

continuously feeding and conveying a plurality of transfer sheets to said fixing means; and controlling said cooling fan to stop revolving when a preceding transfer sheet exists in a predetermined conveying range.

22. The method as claimed in claim 21, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position detecting step and said controlling step are performed only when said thin-sheet mode is set.

23. A method for controlling an image-forming device including fixing means for fixing a toner visible image transferred to a transfer sheet, feeding means for feeding and conveying the transfer sheet to said fixing means, a cooling fan discharging a heat generated in said fixing means by revolving at a variable revolving velocity, and conveyance-position detecting means for detecting a conveyance position of the transfer sheet being conveyed, the method comprising:

detecting the conveyance position of the transfer sheet being conveyed;

controlling the revolving velocity of said cooling fan according to said conveyance position;

continuously feeding and conveying a plurality of transfer sheets to said fixing means; and controlling said cooling fan to stop revolving when a preceding transfer sheet exists in a predetermined conveying range.

24. The method as claimed in claim 23, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position detecting step and said controlling step are performed only when said thin-sheet mode is set.

25. A method for controlling an image-forming device including fixing means for fixing a toner visible image transferred to a transfer sheet, feeding means for feeding and conveying the transfer sheet to said fixing means, a cooling fan discharging a heat generated in said fixing means, and timing means for measuring a conveying time of the transfer sheet being conveyed, the method comprising:

calculating a conveyance position of the transfer sheet being conveyed, based on said conveying time and a predetermined conveying velocity;

controlling said cooling fan to start and stop revolving according to said conveyance position;

continuously feeding and conveying a plurality of transfer sheets to said fixing means; and controlling said cooling fan to stop revolving when a preceding transfer sheet exists in a predetermined conveying range.

26. The method as claimed in claim 25, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position calculating step and said controlling step are performed only when said thin-sheet mode is set.

27. A method for controlling an image-forming device including fixing means for fixing a toner visible image transferred to a transfer sheet, feeding means for feeding and conveying the transfer sheet to said fixing means, a cooling fan discharging a heat generated in said fixing means by revolving at a variable revolving velocity, and timing means for measuring a conveying time of the transfer sheet being conveyed, the method comprising:

calculating a conveyance position of the transfer sheet being conveyed, based on said conveying time and a predetermined conveying velocity;

controlling the revolving velocity of said cooling fan according to said conveyance position;

continuously feeding and conveying a plurality of transfer sheets to said fixing means; and controlling said cooling fan to stop revolving when a preceding transfer sheet exists in a predetermined conveying range.

28. The method as claimed in claim 27, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position calculating step and said controlling step are performed only when said thin-sheet mode is set.

29. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means, and conveyance-position detecting means for detecting a conveyance position of the transfer sheet being conveyed, the method comprising:

detecting the conveyance position of the transfer sheet being conveyed; and controlling said cooling fan to stop revolving when a transfer sheet preceding the present transfer sheet exists between said transferring means and said fixing means while continuously feeding and conveying a plurality of transfer sheets to said fixing means.

30. The method as claimed in claim 29, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position detecting step and said controlling step are performed only when said thin-sheet mode is set.

31. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means by revolving at a variable revolving velocity, and conveyance-position detecting means for detecting a conveyance position of the transfer sheet being conveyed, the method comprising:

detecting the conveyance position of the transfer sheet being conveyed;

controlling said cooling fan to revolve at a revolving velocity lower than an initial revolving velocity upon the start of feeding transfer sheets, when a transfer sheet preceding the present transfer sheet exists between said transferring means and said fixing means, while continuously feeding and conveying a plurality of transfer sheets to said fixing means; and controlling said cooling fan to stop revolving when a preceding transfer sheet exists in a predetermined conveying range.

32. The method as claimed in claim 31, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position detecting step and said controlling step are performed only when said thin-sheet mode is set.

33. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means, and timing means for measuring a conveying time of the transfer sheet being conveyed, the method comprising:

calculating a conveyance position of the transfer sheet being conveyed, based on said conveying time and a predetermined conveying velocity; and controlling said cooling fan to stop revolving when a transfer sheet preceding the present transfer sheet exists between said transferring means and said fixing means while continuously feeding and conveying a plurality of transfer sheets to said fixing means.

34. The method as claimed in claim 33, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position calculating step and said controlling step are performed only when said thin-sheet mode is set.

35. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means by revolving at a variable revolving velocity, and timing means for measuring a conveying time of the transfer sheet being conveyed, the method comprising:

calculating a conveyance position of the transfer sheet being conveyed, based on said conveying time and a predetermined conveying velocity; and controlling said cooling fan to revolve at a revolving velocity lower than an initial revolving velocity upon the start of feeding transfer sheets, when a transfer sheet preceding the present transfer sheet exists between said transferring means and said fixing means, while continuously feeding and conveying a plurality of transfer sheets to said fixing means.

36. The method as claimed in claim 35, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position calculating step and said controlling step are performed only when said thin-sheet mode is set.

37. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means, conveyance-position detecting means for detecting a conveyance position of the transfer sheet being conveyed, and temperature-sensing means for sensing a temperature in said image-forming device, the method comprising:

detecting the conveyance position of the transfer sheet being conveyed;

controlling said cooling fan to stop revolving when a transfer sheet preceding the present transfer sheet exists between said transferring means and said fixing means while continuously feeding and conveying a plurality of transfer sheets to said fixing means; and controlling said cooling fan to start revolving when said temperature in said image-forming device becomes equal to or higher than a predetermined temperature since said cooling fan is stopped revolving by said first controlling step.

38. The method as claimed in claim 37, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position detecting step, said first controlling step, and said second controlling step are performed only when said thin-sheet mode is set.

39. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means by revolving at a variable revolving velocity, conveyance-position detecting means for detecting a conveyance position of the transfer sheet being conveyed, and temperature-sensing means for sensing a temperature in said image-forming device, the method comprising:

detecting the conveyance position of the transfer sheet being conveyed;

controlling said cooling fan to revolve at a revolving velocity lower than an initial revolving velocity upon the start of feeding transfer sheets, when a transfer sheet preceding the present transfer sheet exists between said transferring means and said fixing means, while continuously feeding and conveying a plurality of transfer sheets to said fixing means;

controlling said cooling fan to revolve at said initial revolving velocity when said temperature in said image-forming device becomes equal to or higher than a predetermined temperature since said cooling fan is revolved at the revolving velocity lower than said initial revolving velocity by said first controlling step; and controlling said cooling fan to stop revolving when a preceding transfer sheet exists in a predetermined conveying range.

40. The method as claimed in claim 39, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position detecting step, said first controlling step, and said second controlling step are performed only when said thin-sheet mode is set.

41. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means, and timing means for measuring a conveying time of the transfer sheet being conveyed, the method comprising:

calculating a conveyance position of the transfer sheet being conveyed, based on said conveying time and a predetermined conveying velocity;

controlling said cooling fan to stop revolving when a transfer sheet preceding the present transfer sheet exists between said transferring means and said fixing means while continuously feeding and conveying a plurality of transfer sheets to said fixing means; and the second controlling step of controlling said cooling fan to start revolving when a predetermined time elapses since said cooling fan is stopped revolving by said first controlling step.

42. The method as claimed in claim 41, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position calculating step, said first controlling step, and said second controlling step are performed only when said thin-sheet mode is set.

43. A method for controlling an image-forming device including transferring means for transferring a toner visible image to a transfer sheet, fixing means for fixing the toner visible image transferred to the transfer sheet, feeding means for feeding and conveying the transfer sheet to said fixing means, a cooling fan discharging a heat generated in said fixing means by revolving at a variable revolving velocity, and timing means for measuring a conveying time of the transfer sheet being conveyed, the method comprising:

calculating a conveyance position of the transfer sheet being conveyed, based on said conveying time and a predetermined conveying velocity;

controlling said cooling fan to revolve at a revolving velocity lower than an initial revolving velocity upon the start of feeding transfer sheets, when a transfer sheet preceding the present transfer sheet exists between said transferring means and said fixing means, while continuously feeding and conveying a plurality of transfer sheets to said fixing means;

controlling said cooling fan to revolve at said initial revolving velocity when a predetermined time elapses since said cooling fan is revolved at the revolving velocity lower than said initial revolving velocity by said first controlling step; and controlling said cooling fan to stop revolving when a preceding transfer sheet exists in a predetermined conveying range.

44. The method as claimed in claim 43, wherein said image-forming device includes mode-setting means for setting a thin-sheet mode indicating that said transfer sheet is thinner than a predetermined thickness, the method further comprising:

the mode confirming step of confirming whether or not said thin-sheet mode is set so that said conveyance-position calculating step, said first controlling step, and said second controlling step are performed only when said thin-sheet mode is set.

* * * * *